US011108159B2

(12) United States Patent
Pance et al.

(10) Patent No.: US 11,108,159 B2
(45) Date of Patent: Aug. 31, 2021

(54) DIELECTRIC RESONATOR ANTENNA SYSTEM

(71) Applicant: ROGERS CORPORATION, Chandler, AZ (US)

(72) Inventors: Kristi Pance, Auburndale, MA (US); Gianni Taraschi, Arlington, MA (US); Ingmar Cees Johannes van der Linden, Utrecht (NL); Karl E. Sprentall, Medford, MA (US)

(73) Assignee: ROGERS CORPORATION, Chandler, AZ (US)

( * ) Notice: Subject to any disclaimer, the term of this patent is extended or adjusted under 35 U.S.C. 154(b) by 8 days.

(21) Appl. No.: 16/682,035

(22) Filed: Nov. 13, 2019

(65) Prior Publication Data

US 2020/0083610 A1 Mar. 12, 2020

Related U.S. Application Data

(63) Continuation-in-part of application No. PCT/US2018/036003, filed on Jun. 5, 2018.
(Continued)

(51) Int. Cl.
*H01Q 1/38* (2006.01)
*H01Q 9/04* (2006.01)
(Continued)

(52) U.S. Cl.
CPC ..... *H01Q 9/0485* (2013.01); *H01Q 15/08* (2013.01); *H01Q 19/08* (2013.01); *H01Q 21/0006* (2013.01)

(58) Field of Classification Search
CPC ..... H01Q 9/0485; H01Q 1/38; H01Q 1/48; H01Q 9/0492; H01Q 21/061; H01Q 1/243;
(Continued)

(56) References Cited

U.S. PATENT DOCUMENTS 2,624,002 A 10/1952 Bouix
3,213,454 A * 10/1965 Ringenbach ..... H01Q 3/22 343/754
(Continued)

FOREIGN PATENT DOCUMENTS

EP 0468413 A2 1/1992
EP 0587247 A1 3/1994
(Continued)

OTHER PUBLICATIONS

Buerkle, A. et al; "Fabrication of a DRA Array Using Ceramic Stereolithography"; IEEE Antennas and Wireless Popagation Letters; IEEE; vol. 5,, No. 1, Jan. 2007; pp. 479-481.
(Continued)

*Primary Examiner* — Linh V Nguyen
(74) *Attorney, Agent, or Firm* — Cantor Colburn LLP

(57) ABSTRACT

An electromagnetic device includes: a ground structure; a dielectric resonator antenna (DRA) disposed on the ground structure; an electromagnetic (EM) beam shaper disposed proximate the DRA; and, a signal feed electromagnetically coupled to the DRA. The EM beam shaper includes: an electrically conductive horn; a body of dielectric material having a dielectric constant that varies from an internal portion of the body to an outer surface of the body; or, both the electrically conductive horn and the body of dielectric material.

18 Claims, 16 Drawing Sheets

Related U.S. Application Data

(60) Provisional application No. 62/516,334, filed on Jun. 7, 2017.

(51) Int. Cl.
*H01Q 15/08* (2006.01)
*H01Q 19/08* (2006.01)
*H01Q 21/00* (2006.01)

(58) Field of Classification Search
CPC ..... H01Q 21/30; H01Q 15/08; H01Q 1/422; H01Q 5/50; H01Q 9/0457; H01Q 19/062; H01Q 1/2283; H01Q 1/523; H01Q 9/0407; H01Q 13/10
USPC ..... 343/784–787, 751, 762, 722
See application file for complete search history.

(56) References Cited

U.S. PATENT DOCUMENTS 3,321,765 A 5/1967 Peters et al.
4,366,484 A 12/1982 Weiss et al.
4,743,915 A 5/1988 Rammos et al.
5,227,749 A 7/1993 Raguenet et al.
5,453,754 A 9/1995 Fray
5,589,842 A 12/1996 Wang et al.
5,667,796 A 9/1997 Otten
5,854,608 A 12/1998 Leisten
5,867,120 A * 2/1999 Ishikawa ..... H01Q 19/062 342/175
5,940,036 A 8/1999 Oliver et al.
5,952,972 A 9/1999 Ittipiboon et al.
6,031,433 A 2/2000 Tanizaki et al.
6,052,087 A 4/2000 Ishikawa et al.
6,061,026 A 5/2000 Ochi et al.
6,061,031 A 5/2000 Cosenza et al.
6,075,485 A 6/2000 Lilly et al.
6,147,647 A 11/2000 Tassoudji et al.
6,181,297 B1 1/2001 Leisten
6,188,360 B1 2/2001 Kato et al.
6,198,450 B1 3/2001 Adachi et al.
6,268,833 B1 7/2001 Tanizaki et al.
6,292,141 B1 9/2001 Lim
6,314,276 B1 11/2001 Hilgers et al.
6,317,095 B1 11/2001 Teshirogi et al.
6,323,808 B1 11/2001 Heinrichs et al.
6,323,824 B1 11/2001 Heinrichs et al.
6,344,833 B1 2/2002 Lin et al.
6,373,441 B1 4/2002 Porath et al.
6,437,747 B1 8/2002 Stoiljkovic et al.
6,476,774 B1 11/2002 Davidson et al.
6,528,145 B1 3/2003 Berger et al.
6,552,687 B1 4/2003 Rawnick et al.
6,556,169 B1 4/2003 Fukuura et al.
6,621,381 B1 9/2003 Kundu et al.
6,743,744 B1 6/2004 Kim et al.
6,794,324 B1 9/2004 Kim et al.
6,816,118 B2 11/2004 Kingsley et al.
6,816,128 B1 11/2004 Jennings
7,161,535 B2 1/2007 Palmer et al.
7,179,844 B2 2/2007 Aki et al.
7,183,975 B2 2/2007 Thomas et al.
7,196,663 B2 3/2007 Bozer et al.
7,253,789 B2 8/2007 Kingsley et al.
7,292,204 B1 11/2007 Chang et al.
7,310,031 B2 12/2007 Pance et al.
7,379,030 B1 * 5/2008 Lier ..... H01Q 13/00 343/772
7,382,322 B1 6/2008 Yang et al.
7,405,698 B2 7/2008 De Rochemont
7,443,363 B2 10/2008 Ying
7,498,969 B1 3/2009 Paulsen et al.
7,545,327 B2 6/2009 Iellici et al.
7,570,219 B1 8/2009 Paulsen et al.
7,595,765 B1 9/2009 Hirsch et al.
7,636,063 B2 12/2009 Channabasappa
7,663,553 B2 2/2010 Chang et al.
7,710,325 B2 5/2010 Cheng
7,835,600 B1 * 11/2010 Yap ..... H01Q 13/02 385/12
7,876,283 B2 1/2011 Bouche et al.
7,961,148 B2 6/2011 Goldberger
8,098,197 B1 1/2012 Herting et al.
8,497,804 B2 7/2013 Haubrich et al.
8,498,539 B1 7/2013 Iichenko et al.
8,736,502 B1 5/2014 Langfield et al.
8,773,319 B1 7/2014 Anderson et al.
8,902,115 B1 12/2014 Loui et al.
9,112,273 B2 8/2015 Christie et al.
9,184,697 B2 11/2015 Sekiguchi et al.
9,225,070 B1 12/2015 Zeweri et al.
9,455,488 B2 9/2016 Chirila
9,608,330 B2 3/2017 Singleton et al.
9,825,373 B1 11/2017 Smith
9,917,044 B2 3/2018 Zhou et al.
9,930,668 B2 * 3/2018 Barzegar ..... H04L 5/0003
10,355,361 B2 7/2019 Pance et al.
10,476,164 B2 11/2019 Pance et al.
10,522,917 B2 12/2019 Pance et al.
10,587,039 B2 3/2020 Pance et al.
10,601,137 B2 3/2020 Pance et al.
2001/0013842 A1 8/2001 Ishikawa et al.
2001/0043158 A1 11/2001 Adachi et al.
2002/0000947 A1 1/2002 Al-Rawi et al.
2002/0057138 A1 5/2002 Takagi et al.
2002/0180646 A1 12/2002 Kivekas et al.
2002/0196190 A1 12/2002 Lim
2003/0016176 A1 1/2003 Kingsley et al.
2003/0034922 A1 2/2003 Isaacs et al.
2003/0043075 A1 3/2003 Bit-Babik et al.
2003/0122729 A1 7/2003 Diaz et al.
2003/0151548 A1 8/2003 Kingsley et al.
2003/0181312 A1 9/2003 Mailadil et al.
2004/0029709 A1 2/2004 Oba et al.
2004/0036148 A1 2/2004 Block et al.
2004/0051602 A1 3/2004 Pance et al.
2004/0080455 A1 4/2004 Lee
2004/0113843 A1 6/2004 Le Bolzer et al.
2004/0119646 A1 6/2004 Ohno et al.
2004/0127248 A1 7/2004 Lin et al.
2004/0130489 A1 7/2004 Le Bolzer et al.
2004/0155817 A1 8/2004 Kingsley et al.
2004/0233107 A1 11/2004 Popov et al.
2004/0257176 A1 12/2004 Pance et al.
2004/0263422 A1 12/2004 Lynch
2005/0017903 A1 1/2005 Ittipiboon et al.
2005/0024271 A1 2/2005 Ying et al.
2005/0057402 A1 3/2005 Ohno et al.
2005/0099348 A1 5/2005 Pendry
2005/0122273 A1 6/2005 Legay et al.
2005/0162316 A1 7/2005 Thomas et al.
2005/0179598 A1 8/2005 Legay et al.
2005/0200531 A1 9/2005 Huang et al.
2005/0219130 A1 10/2005 Koch et al.
2005/0225499 A1 10/2005 Kingsley et al.
2005/0242996 A1 11/2005 Palmer et al.
2005/0264449 A1 12/2005 Strickland
2005/0264451 A1 12/2005 Aikawa et al.
2006/0022875 A1 2/2006 Pidwerbetsky et al.
2006/0119518 A1 6/2006 Ohmi et al.
2006/0145705 A1 7/2006 Raja
2006/0194690 A1 8/2006 Osuzu
2006/0232474 A1 10/2006 Fox
2006/0293651 A1 12/2006 Cronin
2007/0152884 A1 7/2007 Bouche et al.
2007/0164420 A1 7/2007 Chen et al.
2007/0252778 A1 11/2007 Ide et al.
2008/0036675 A1 2/2008 Fujieda
2008/0042903 A1 * 2/2008 Cheng ..... H01Q 9/0485 343/700 MS
2008/0048915 A1 2/2008 Chang et al.
2008/0094309 A1 * 4/2008 Pance ..... H01Q 9/0485 343/911 R
2008/0122703 A1 5/2008 Ying

(56) References Cited

U.S. PATENT DOCUMENTS

2008/0129616 A1 6/2008 Li et al.
2008/0129617 A1 6/2008 Li et al.
2008/0260323 A1 10/2008 Jalali et al.
2008/0272963 A1 11/2008 Chang et al.
2008/0278378 A1 11/2008 Chang et al.
2009/0040131 A1 2/2009 Mosallaei
2009/0073332 A1 3/2009 Irie
2009/0102739 A1 4/2009 Chang et al.
2009/0128262 A1 5/2009 Lee et al.
2009/0128434 A1 5/2009 Chang et al.
2009/0140944 A1 6/2009 Chang et al.
2009/0153403 A1 6/2009 Chang et al.
2009/0179810 A1 7/2009 Kato et al.
2009/0184875 A1 7/2009 Chang et al.
2009/0206957 A1 8/2009 Hiroshima et al.
2009/0262022 A1 10/2009 Ying
2009/0270244 A1 10/2009 Chen et al.
2009/0305652 A1 12/2009 Boffa et al.
2010/0051340 A1 3/2010 Yang et al.
2010/0103052 A1 4/2010 Ying
2010/0156754 A1 6/2010 Kondou
2010/0220024 A1 9/2010 Snow et al.
2010/0231452 A1* 9/2010 Babakhani ..... H01Q 9/065 342/368
2011/0012807 A1 1/2011 Sorvala
2011/0050367 A1 3/2011 Yen et al.
2011/0121258 A1 5/2011 Hanein et al.
2011/0122036 A1 5/2011 Leung et al.
2011/0133991 A1 6/2011 Lee et al.
2011/0248890 A1 10/2011 Lee et al.
2012/0092219 A1 4/2012 Kim
2012/0212386 A1 8/2012 Massie et al.
2012/0242553 A1 9/2012 Leung et al.
2012/0245016 A1 9/2012 Curry et al.
2012/0256796 A1 10/2012 Leiba
2012/0274523 A1 11/2012 Ayatollahi
2012/0276311 A1 11/2012 Chirila
2012/0287008 A1 11/2012 Kim
2012/0306713 A1 12/2012 Raj et al.
2012/0329635 A1 12/2012 Hill
2013/0076570 A1 3/2013 Lee et al.
2013/0088396 A1 4/2013 Han
2013/0113674 A1 5/2013 Ryu
2013/0120193 A1 5/2013 Hoppe et al.
2013/0234898 A1 9/2013 Leung et al.
2013/0278610 A1 10/2013 Stephanou et al.
2014/0043189 A1 2/2014 Lee et al.
2014/0327591 A1 11/2014 Kokkinos
2014/0327597 A1 11/2014 Rashidian et al.
2015/0035714 A1 2/2015 Zhou
2015/0077198 A1 3/2015 Yatabe
2015/0138036 A1 4/2015 Harper
2015/0207233 A1* 7/2015 Kim ..... H01Q 9/0485 343/785
2015/0207234 A1 7/2015 Ganchrow et al.
2015/0236428 A1 8/2015 Caratelli et al.
2015/0244082 A1 8/2015 Caratelli et al.
2015/0303546 A1 10/2015 Rashidian et al.
2015/0314526 A1 11/2015 Cohen
2015/0346334 A1* 12/2015 Nagaishi ..... H01Q 1/421 342/115
2015/0380824 A1 12/2015 Tayfeh Aligodarz et al.
2016/0111769 A1 4/2016 Pance et al.
2016/0218437 A1 7/2016 Guntupalli et al.
2016/0294066 A1 10/2016 Djerafi et al.
2016/0294068 A1* 10/2016 Djerafi ..... H01Q 21/293
2016/0322708 A1 11/2016 Tayfeh Aligodarz et al.
2016/0351996 A1 12/2016 Ou
2016/0372955 A1 12/2016 Fackelmeier et al.
2017/0018851 A1 1/2017 Henry et al.
2017/0040700 A1* 2/2017 Leung ..... H01Q 9/0485
2017/0125901 A1 5/2017 Sharawi et al.
2017/0125908 A1 5/2017 Pance et al.
2017/0125909 A1 5/2017 Pance et al.
2017/0125910 A1 5/2017 Pance et al.
2017/0179569 A1 6/2017 Kim et al.
2017/0188874 A1 7/2017 Suhami
2017/0256847 A1 9/2017 Vollmer et al.
2017/0271772 A1 9/2017 Miraftab et al.
2017/0272149 A1 9/2017 Michaels
2018/0054234 A1 2/2018 Stuckman et al.
2018/0069594 A1 3/2018 Henry et al.
2018/0115072 A1 4/2018 Pance et al.
2018/0309202 A1 10/2018 Pance et al.
2018/0323514 A1 11/2018 Pance et al.
2019/0020105 A1 1/2019 Pance et al.
2019/0128624 A1* 5/2019 Cohen ..... H01Q 15/0093
2019/0214732 A1 7/2019 Leung et al.
2019/0221926 A1 7/2019 Pance et al.
2019/0221939 A1 7/2019 George et al.
2019/0221940 A1 7/2019 Pance et al.
2019/0319357 A1 10/2019 Pance et al.
2019/0319358 A1 10/2019 Pance et al.
2019/0379123 A1 12/2019 Leung et al.
2019/0393607 A1 12/2019 Pance et al.
2020/0083602 A1 3/2020 Sethumadhavan et al.
2020/0083609 A1 3/2020 Pance et al.
2020/0099136 A1 3/2020 Pance et al.
2020/0194881 A1 6/2020 Pance et al.
2020/0227827 A1* 7/2020 Vollmer ..... H01Q 21/061

FOREIGN PATENT DOCUMENTS

EP 0801436 A2 10/1997
EP 1783516 A1 5/2007
EP 2905632 A1 8/2015
JP 2004112131 A 4/2004
WO 2017075184 A1 5/2017

OTHER PUBLICATIONS

Guo, Yomg-Xin, et al.,; "Wide-Band Stacked Double Annular-Ring Dielectric Resonator Antenna at the End-Fire Mode Operation"; IEEE Transacions on Antennas and Propagation; vol. 53; No. 10; Oct. 2005; 3394-3397 pages.

Kakade, A.B., et al; "Analysis of the Rectangular Waveguide Slot Coupled Multilayer hemispherical Dielectric Resonator Antenna"; IET Microwaves, Antennas & Propagation, The Institution of Engineering and Technology; vol. 6; No. 3; Jul. 11, 2011; 338-347 pages.

Kakade, Anandrao, et al.; Mode Excitation in the Coaxial Probe Coupled Three-Layer Hemispherical Dielectric Resonator Antenna; IEEE Transactions on Antennas and Propagation; vol. 59; No. 12; Dec. 2011; 7 pages.

Notification of Transmittal of the International Search Report and the Written Opinion of the international Searching Authority, or the Declaration for International Application No. PCT/US2018/036003; Report dated Sep. 10, 2018; Report Received Date: Sep. 17, 2018; 18 pages.

Petosa, Aldo, et al.; "Dielectric Resonator Antennas: A Historical Review and the Current State of the Art"; IEEE Antennas and Propagation Magazine; vol. 52, No. 5, Oct. 2010; 91-116 pages.

Wong, Kin-Lu, et al.,; "Analysis of a Hemispherical Dielectric Resonator Antenna with an Airgap"; IEEE Microwave and Guided Wave Letters; vol. 3; No. 9; Oct. 3, 1993; 355-357 pages.

Zainud-Deen, S H et al; "Dielectric Resonator Antenna Phased Array for Fixed RFID Reader in Near Field Region"; IEEE; Mar. 6, 2012; pp. 102-107.

Kishk, A. Ahmed, et al.,; "Analysis of Dielectric-Resonator with Emphasis on Hemispherical Structures"; IEEE Antennas & Propagation Magazine; vol. 36; No. 2; Apr. 1994; 20-31 pages.

Raghvendra Kumar Chaudhary et al; Variation of Permittivity in Radial Direction in Concentric Half-Split Cylindrical Dielectric Resonator Antenna for Wideband Application: Permittivity Variation in R-Dir. in CDRA; International Journal of Rf and Microwave Computer-Aided Engineering; vol. 25; No. 4; May 1, 2015; pp. 321-329.

Ruan, Yu-Feng, et al; "Antenna Effects Consideration for Space-Time Coding UWB-Impulse Radio System in IEEE 802.15 Multipath Channel"; Wireless Communications, Networking and Mobile Computing; 2006; 1-4 pages.

(56) References Cited

OTHER PUBLICATIONS

Zhang Shiyu et al.; "3D-Printed Graded Index Lenses for RF Applications"; ISAP 2016 International Symposium on Antennas and Propagation, Okinawa, Japan.; pp. 1-27.

* cited by examiner

| Name | Theta | Ang | Mag |
|---|---|---|---|
| m1 | 360.0000 | -0.0000 | 21.4339 |
| m2 | 0.0000 | 0.0000 | 9.2694 |

| Curve Info | |
|---|---|
| - - - - | dB(RealizedGainTotal)<br>Setup1 : LastAdaptive<br>Freq = '77GHz' Phi = '90deg' |
| ——— | dB(RealizedGainTotal)_1<br>Imported<br>Freq = '77GHz' Phi = '90deg' |

DIELECTRIC RESONATOR ANTENNA SYSTEM

CROSS REFERENCE TO RELATED APPLICATIONS

This application is a continuation-in-part application under 35 U.S.C. 111(a) pursuant to 35 U.S.C. 365(c) of international application PCT/US2018/036003, filed 5 Jun. 2018, which claims priority to U.S. Provisional Application Ser. No. 62/516,334, filed 7 Jun. 2017, all of which are incorporated herein by reference in their entireties.

BACKGROUND OF THE INVENTION

The present disclosure relates generally to an electromagnetic device, particularly to a dielectric resonator antenna (DRA) system, and more particularly to a DRA system with an electromagnetic beam shaper for enhancing the gain, collimation and directionality of a DRA within the DRA system, which is well suited for microwave and millimeter wave applications.

While existing DRA resonators and arrays may be suitable for their intended purpose, the art of DRAs would be advanced with an electromagnetic device useful for building a high gain DRA system with high directionality in the far field that can overcome existing drawbacks, such as limited bandwidth, limited efficiency, limited gain, limited directionality, or complex fabrication techniques, for example.

BRIEF DESCRIPTION OF THE INVENTION

An embodiment includes an electromagnetic device, comprising: an electrically conductive ground structure; at least one dielectric resonator antenna (DRA) disposed on the ground structure; at least one electromagnetic (EM) beam shaper disposed proximate a corresponding one of the DRA; and, at least one signal feed disposed electromagnetically coupled to a corresponding one of the DRA. The at least one EM beam shaper comprises: an electrically conductive horn; a body of dielectric material having a dielectric constant that varies from an internal portion of the body to an outer surface of the body; or, both the electrically conductive horn and the body of dielectric material.

An embodiment includes an electromagnetic device, comprising: an array of individual three-dimensional dielectric resonator antennas (DRAs) arranged in a non-planar arrangement.

An embodiment includes an electromagnetic device, comprising: an electrically conductive ground structure; an array of dielectric resonator antennas (DRAs) disposed on the ground structure, wherein the ground structure is arranged in a non-planar arrangement; an array of electromagnetic (EM) beam shapers disposed in one-to-one correspondence proximate a corresponding one of the DRAs; and a plurality of signal feeds disposed in one-to-one correspondence with and electromagnetically coupled to a corresponding one of the DRAs.

The above features and advantages and other features and advantages of the invention are readily apparent from the following detailed description of the invention when taken in connection with the accompanying drawings.

BRIEF DESCRIPTION OF THE DRAWINGS

Referring to the exemplary non-limiting drawings wherein like elements are numbered alike in the accompanying Figures.

DETAILED DESCRIPTION OF THE INVENTION

Although the following detailed description contains many specifics for the purposes of illustration, anyone of ordinary skill in the art will appreciate that many variations and alterations to the following details are within the scope of the claims. Accordingly, the following example embodiments are set forth without any loss of generality to, and without imposing limitations upon, the claimed invention.

Embodiments disclosed herein include different arrangements for an EM device useful for building a high gain DRA system with high directionality in the far field. An embodiment of an EM device as disclosed herein includes one or more DRAs that may be singly fed, selectively fed, or multiply fed by one or more signal feeds, and may include at least one EM beam shaper disposed proximate a corresponding one of the DRAs in such a manner as to increase the gain and directionality of the far field radiation pattern over a DRA system absent such an EM beam shaper. Example EM beam shapers include an electrically conductive horn, and a body of dielectric material such as a Luneburg lens, which will now be discussed in combination with the several figures provided herewith.

Figure 1B:
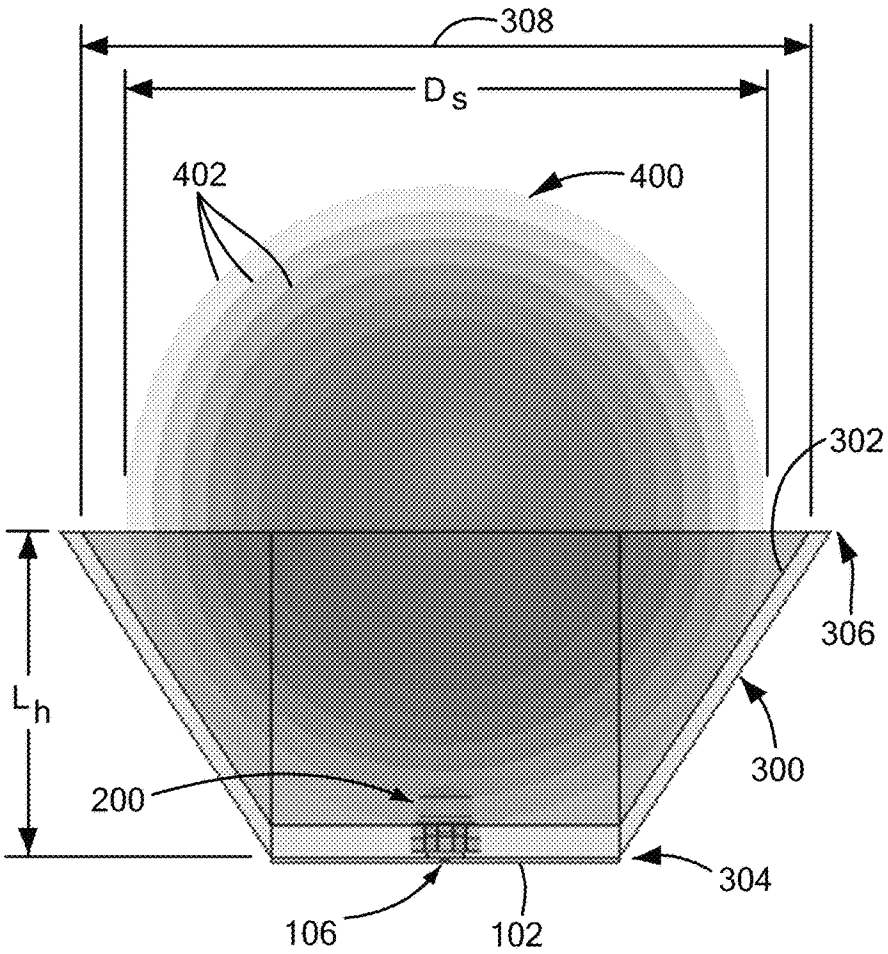
FIG. 1B depicts an elevation view cross section through section line 1B-1B of the electromagnetic device of FIG. 1A, in accordance with an embodiment.
Figure 1A:
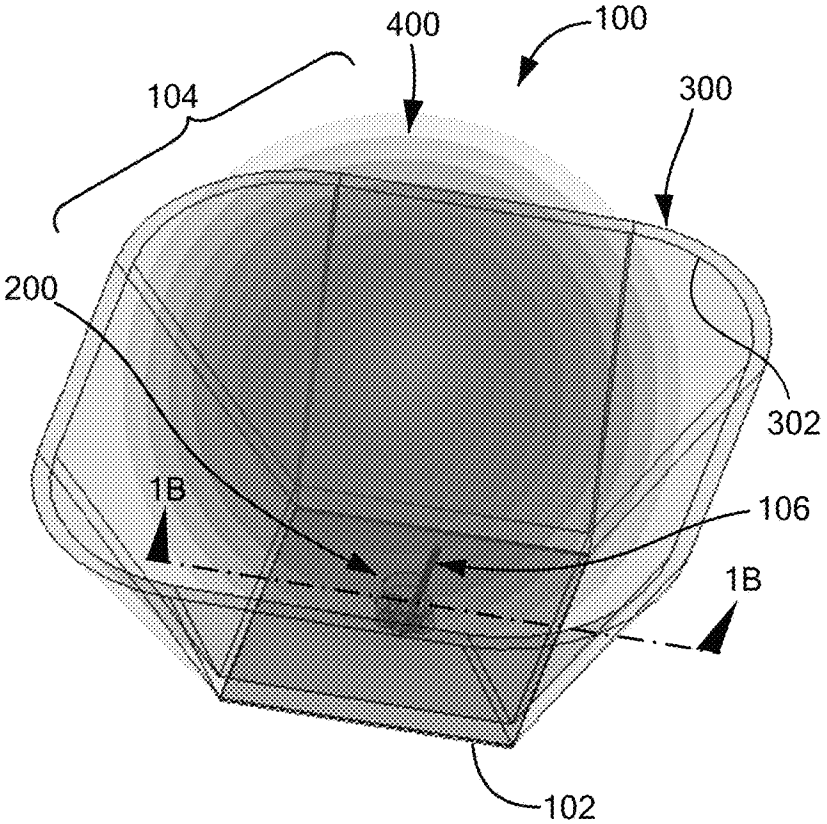
FIG. 1A depicts a rotated isometric view of an example electromagnetic device useful for building a high gain DRA system having both an electromagnetic horn and a spherical lens, in accordance with an embodiment.

With reference now to FIGS. 1A and 1B, an embodiment of an electromagnetic device 100 includes: an electrically conductive ground structure 102; at least one DRA 200 disposed on the ground structure 102; at least one EM beam shaper 104 disposed proximate a corresponding one of the DRA 200; and at least one signal feed 106 disposed electromagnetically coupled to a corresponding one of the DRA 200 to electromagnetically excite the corresponding DRA 200.

In general, excitation of a given DRA 200 is provided by a signal feed, such as a copper wire, a coaxial cable, a microstrip with slotted aperture, a waveguide, a surface integrated waveguide, or a conductive ink, for example, that is electromagnetically coupled to a particular volume of the dielectric material of the DRA 200. As will be appreciated by one skilled in the art, the phrase electromagnetically coupled is a term of art that refers to an intentional transfer of electromagnetic energy from one location to another without necessarily involving physical contact between the two locations, and in reference to an embodiment disclosed herein more particularly refers to an interaction between a signal source having an electromagnetic resonant frequency that coincides with an electromagnetic resonant mode of the associated DRA. In those signal feeds that are directly embedded in the DRA, the signal feed passes through the ground structure, in non-electrical contact with the ground structure, via an opening in the ground structure into a volume of dielectric material. As used herein, reference to dielectric materials other than non-gaseous dielectric materials includes air, which has a relative permittivity ($\varepsilon_r$) of approximately one at standard atmospheric pressure (1 atmosphere) and temperature (20 degree Celsius). As used herein, the term "relative permittivity" may be abbreviated to just "permittivity" or may be used interchangeably with the term "dielectric constant". Regardless of the term used, one skilled in the art would readily appreciate the scope of the invention disclosed herein from a reading of the entire inventive disclosure provided herein.

Figure 1C:
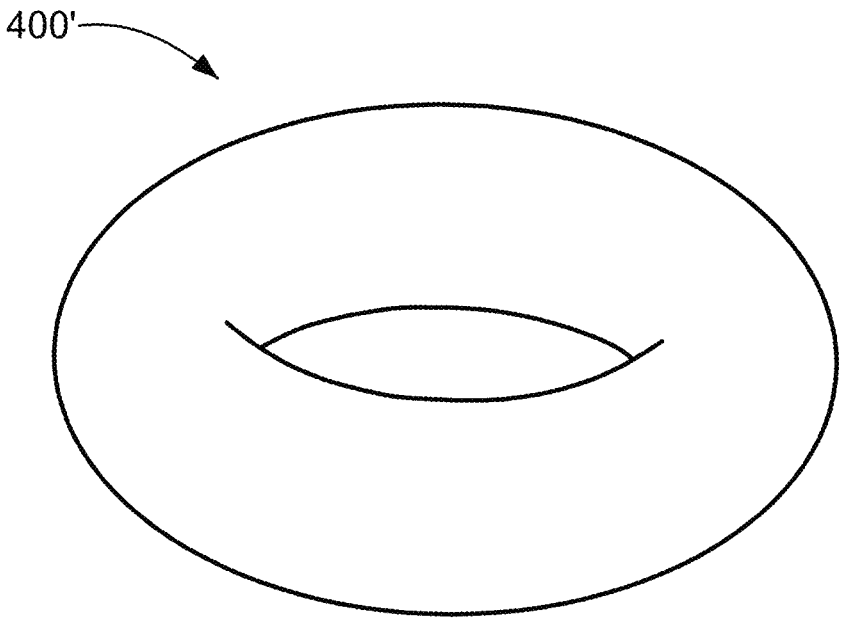
FIG. 1C depicts a rotated isometric view of an example body of dielectric material having a shape other than a spherical shape, in accordance with an embodiment.

In an embodiment, the at least one EM beam shaper 104 comprises: an electrically conductive horn 300; a body of dielectric material 400 (also herein referred to as a dielectric lens, or simply a lens) having a dielectric constant that varies from an inner portion of the body to an outer surface of the body; or, both the electrically conductive horn 300 and the body of dielectric material 400. In an embodiment, the body of dielectric material 400 is a sphere, where the dielectric constant of the sphere varies from the center of the sphere to the outer surface of the sphere. In an embodiment, the dielectric constant of the sphere varies as 1/R, where R is the outer radius of the sphere. While embodiments depicted in the several figures provided herewith illustrate a sphere of dielectric material 400 as a planar construct, it will be appreciated that such illustration is merely due to a drafting limitation and in no way is intended to limit the scope of the invention, which in an embodiment is directed to a three dimensional body, sphere for example, of dielectric material 400. Furthermore, it will be appreciated that the body of dielectric material 400 may be any other three dimensional shape suitable for a purpose disclosed herein, such as but not limited to a toroidal shape 400' for example (best seen with reference to FIG. 1C), where the dielectric constant of the three dimensional shape varies other than 1/R', where R' is the outer radius of the example toroidal shape. As such, while some embodiments depicted and described herein refer to the body of dielectric material specifically being a sphere, it will be appreciated that this is for illustrative purposes only and that the body of dielectric material may be any three dimensional body suitable for a purpose disclosed herein.

In an embodiment and with reference particularly to FIGS. 2A, 2B, 2C, 2D and 2E, the at least one DRA 200 (individually denoted in FIGS. 2A-2E by reference numerals 200A, 200B, 200C, 200D and 200E, respectively) comprises at least one of: a multi-layered DRA 200A comprising two or more dielectric materials 200A.1, 200A.2, 200A.3 with different dielectric constants and where at least two of the dielectric materials 200A.2 and 200A.3 are non-gaseous dielectric materials; a single-layered DRA 200B having a hollow core 200B.1 enveloped by a single layer of non-gaseous dielectric material 200B.2; a DRA 200A, 200B having a convex top 202A, 202B; a DRA 200C comprising a plan view cross section having a geometric form 206C other than a rectangle; a DRA 200C, 200D comprising a plan view cross section having a geometric form 206C, 206D of a circle, an oval, an ovaloid, an ellipse, or an ellipsoid; a DRA 200A, 200B comprising an elevation view cross section having a geometric form 208A, 208B other than a rectangle; a DRA 200A comprising an elevation view cross section having vertical side walls 204A and a convex top 202A; or, a DRA 200E having an overall height Hv and an overall width Wv where the overall height Hv is greater than the overall width Wv.

Figure 2B:
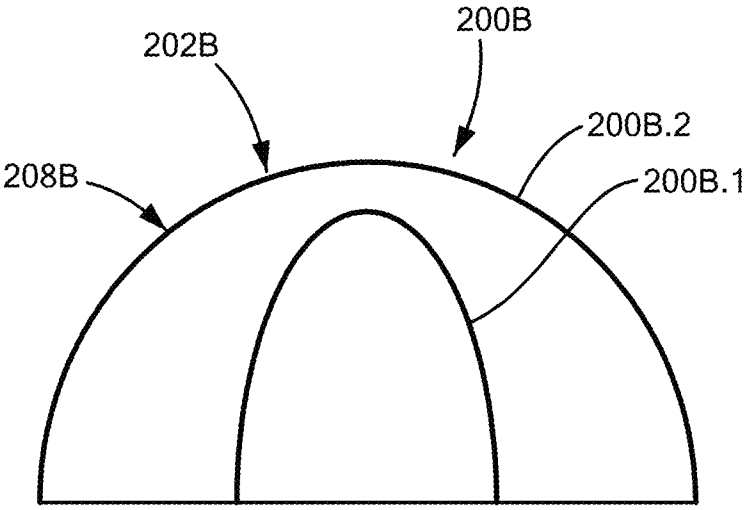
FIGS. 2A, 2B, 2C, 2D and 2E, depict, respectively, an elevation view cross section, an elevation view cross section, a plan view cross section, a plan view cross section, and an elevation view cross section, of alternative embodiments of a DRA suitable for a purpose disclosed herein, in accordance with an embodiment.
Figure 2A:
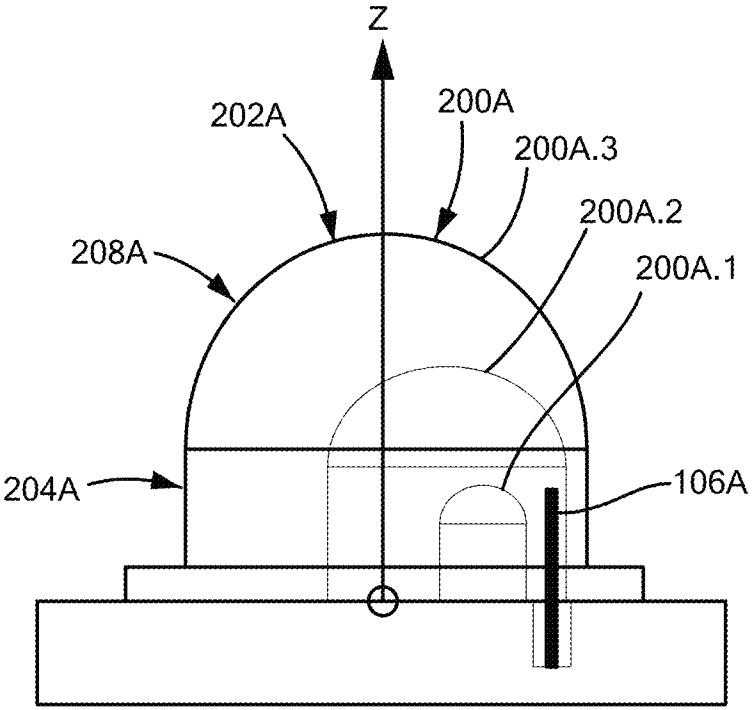

In an embodiment and with reference particularly to FIG. 2A, DRA 200A comprises a plurality of volumes of dielectric materials 200A.1, 200A.2, 200A.3 comprising N volumes (N=3 in FIG. 2A), N being an integer equal to or greater than 3, disposed to form successive and sequential layered volumes V(i), i being an integer from 1 to N, wherein volume V(1) 200A.1 forms an innermost first volume, wherein a successive volume V(i+1) forms a layered shell disposed over and at least partially embedding volume V(i), wherein volume V(N) 200A.3 at least partially embeds all volumes V(1) to V(N−1), and wherein a corresponding signal feed 106A is disposed electromagnetically coupled to one of the plurality of volumes of dielectric materials 200A.2. In an embodiment, the innermost first volume V(1) 200A.1 comprises a gaseous dielectric medium (i.e., the DRA 200A has a hollow core 200A.1).

Figure 2D:
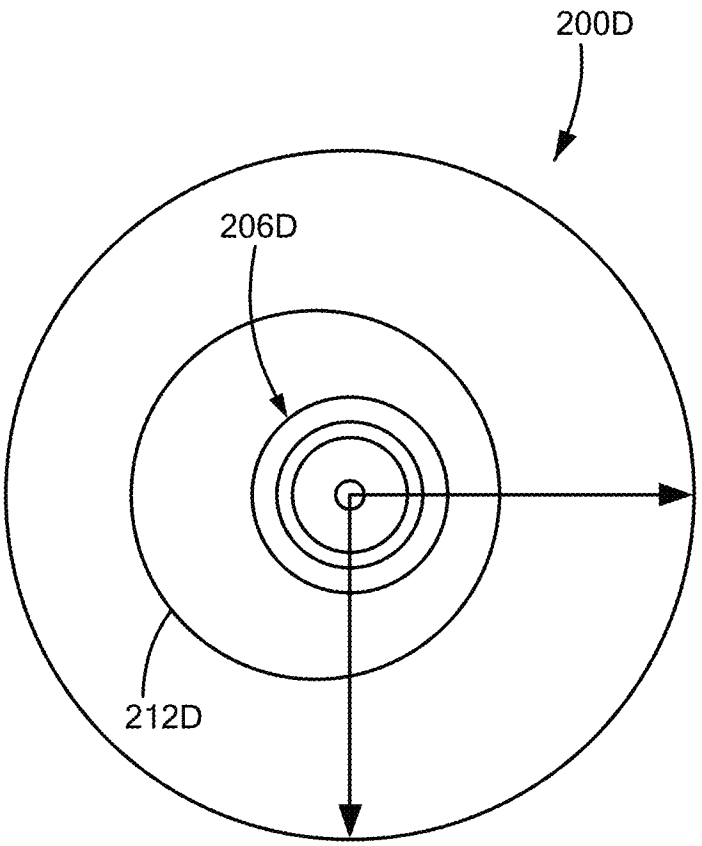
Figure 2C:
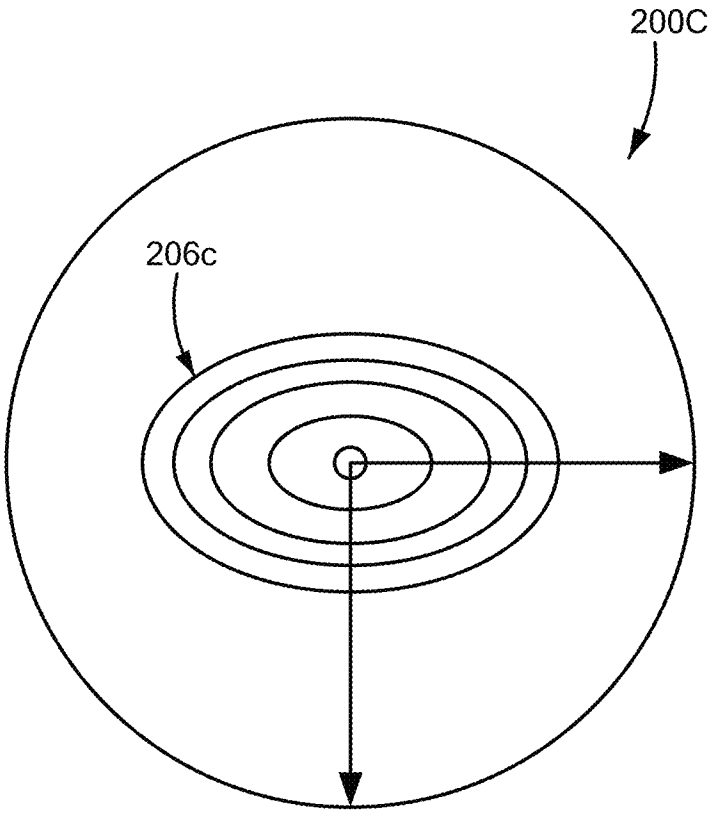
Figure 2E:
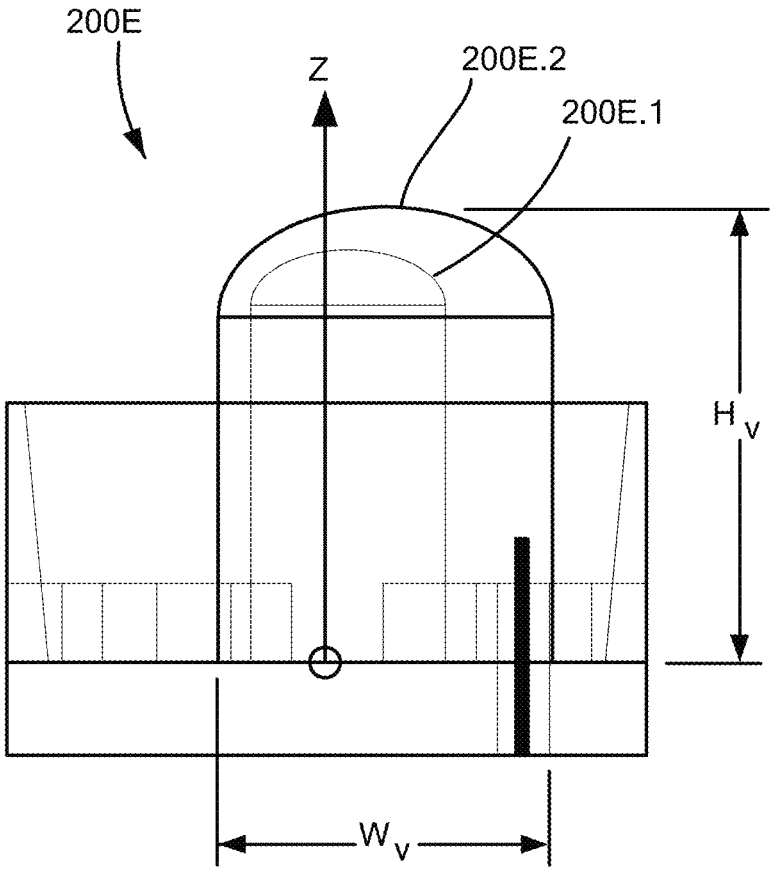

In an embodiment and with reference particularly to FIG. 2E, DRA 200E comprises a volume comprising non-gaseous dielectric material 200E.2, the volume having a hollow core 200E.1, a cross sectional overall maximum height Hv as observed in an elevation view, and a cross sectional overall maximum width Wv as observed in a plan view (as seen in FIG. 2E in the elevation view), wherein the volume is a volume of a single dielectric material composition, and wherein Hv is greater than Wv. In an embodiment, the hollow core 200E.1 comprises air.

It will be appreciated from the foregoing description relating to FIGS. 2A-2F that embodiments of any DRA 200 suitable for a purpose disclosed herein may have any combination of the structural attributes depicted in FIGS. 2A-2F, such as a single-layer or a multi-layer DRA with or without a hollow core where the cross sectional overall maximum height Hv of the DRA is greater than the cross sectional overall maximum width Wv of the corresponding DRA.

Also, and with reference to FIGS. 2A, 2C and 2D, embodiments of any DRA 200 suitable for a purpose disclosed herein may have individual volumes of dielectric materials sideways shifted with respect to each other as depicted in FIG. 2A, may have individual volumes of dielectric materials centrally disposed with respect to each other as depicted in FIG. 2C, or may have a series of inner ones of individual volumes of dielectric materials 206D centrally disposed with respect to each other and an enveloping volume 212D of dielectric material sideways shifted with respect to the series of inner volumes as depicted in FIG. 2D. Any and all such combinations of structural attributes disclosed individually herein but not necessarily disclosed in certain combinations in a given DRA are contemplated and considered to be within the scope of the invention disclosed herein.

Figure 3B:
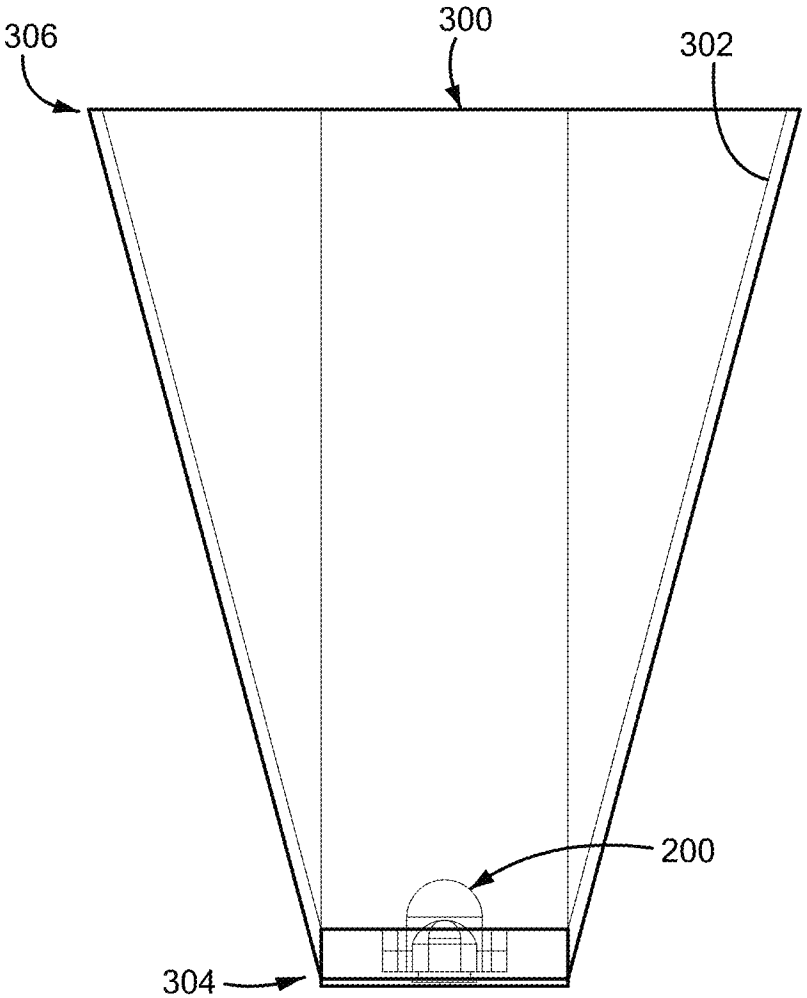
FIG. 3B depicts an elevation view cross section through section line 3B-3B of the electromagnetic device of FIG. 3A, in accordance with an embodiment.
Figure 3A:
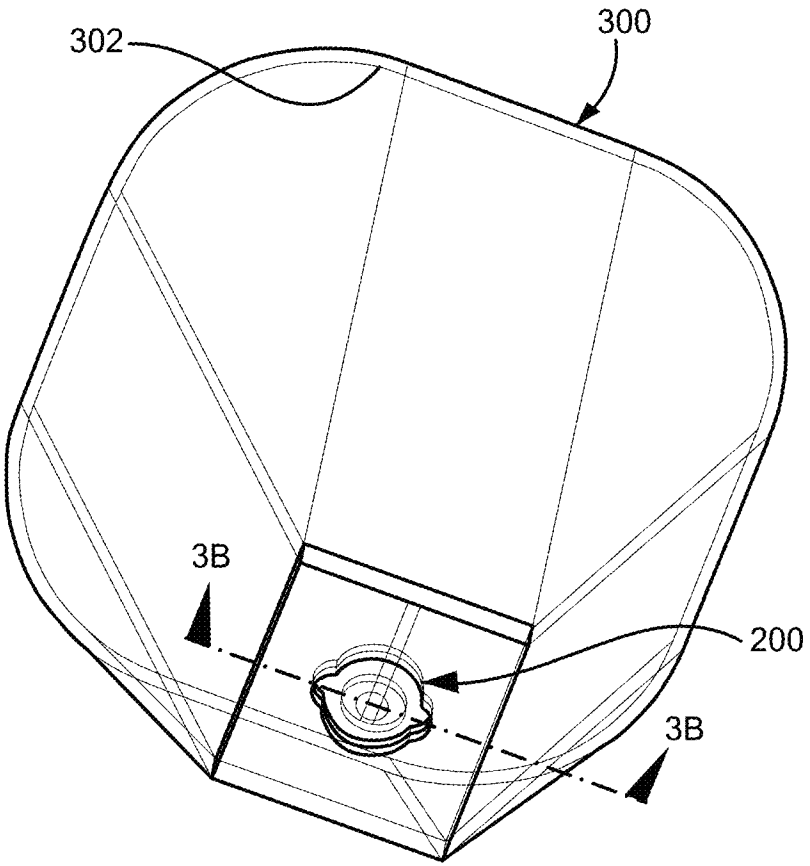
FIG. 3A depicts a rotated isometric view of an example electromagnetic device useful for building a high gain DRA system having an electromagnetic horn absent a spherical lens, in accordance with an embodiment.

With reference to FIGS. 3A and 3B in combination with FIGS. 1A and 1B, in an embodiment where the EM beam shaper 104 comprises an electrically conductive horn 300, the electrically conductive horn 300 may comprise side walls 302 that diverge outwards from a first proximal end 304 to a second distal end 306, the first proximal end 304 being disposed in electrical contact with the ground structure 102, the second distal end 306 being disposed at a distance from the associated at least one DRA 200, and the side walls 302 being disposed surrounding or substantially surrounding the associated at least one DRA 200. In an embodiment, and with reference particularly to FIG. 1B, the length Lh of the electrically conductive horn 300 is less than the diameter Ds of the sphere of dielectric material 400. In an embodiment, the distal end 306 of the electrically conductive horn 300 has an aperture 308 that is equal to or greater than the diameter Ds of the sphere of dielectric material 400. More generally, the distal end 306 of the electrically conductive horn 300 has an aperture 308 that is equal to or greater than the overall outside dimension of the body of dielectric material 400.

Figure 4:
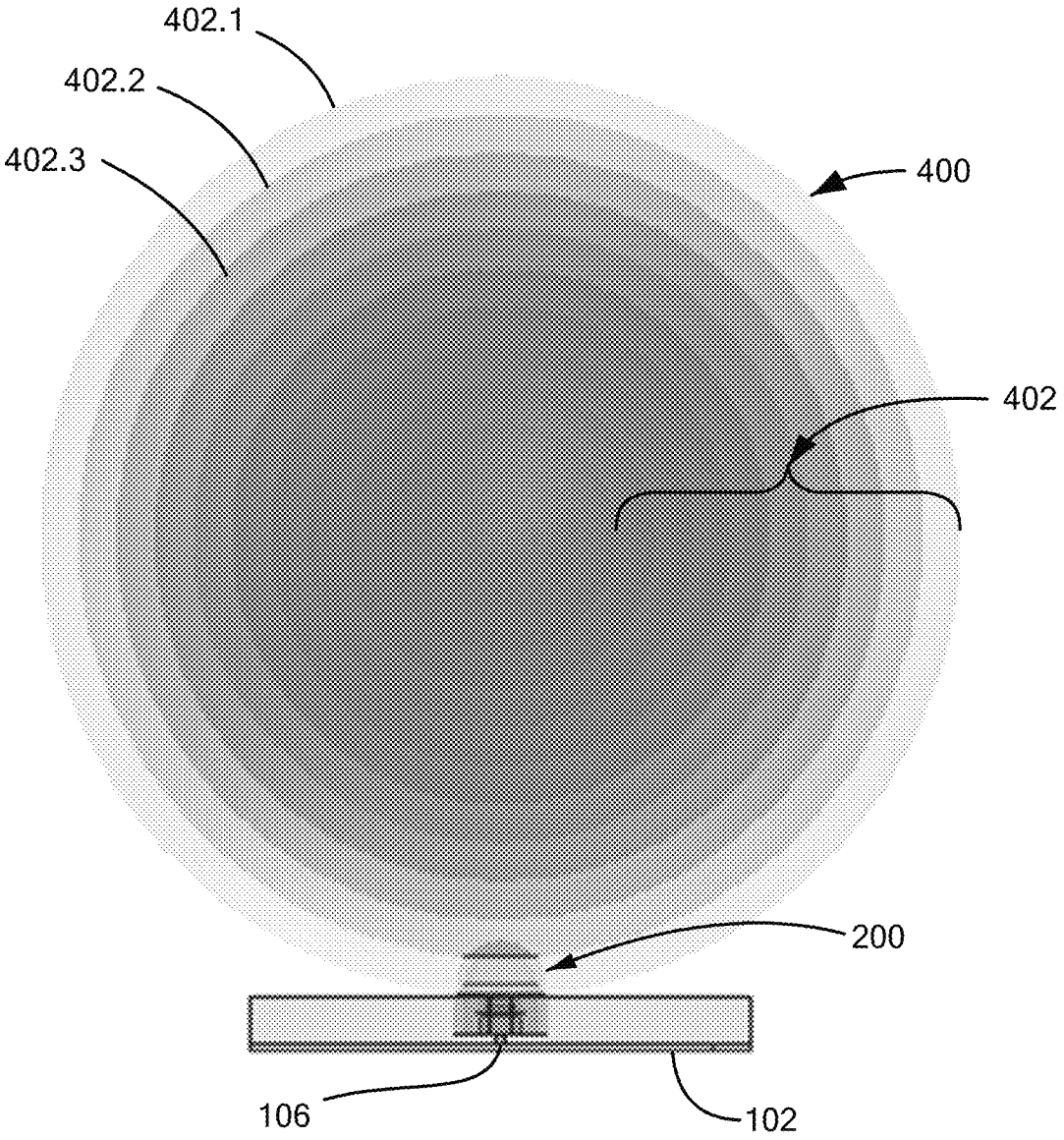
FIG. 4 depicts an elevation view cross section of an example electromagnetic device useful for building a high gain DRA system having a spherical lens absent an electromagnetic horn where the DRA is at least partially embedded in the spherical lens, in accordance with an embodiment.

With reference to FIG. 1B and FIG. 4, in an embodiment where the EM beam shaper 104 comprises a sphere of dielectric material 400, the sphere of dielectric material 400 has a dielectric constant that decreases from the center of the sphere to the surface of the sphere. For example, the dielectric constant at the center of the sphere may be 2, 3, 4, 5, or any other value suitable for a purpose disclosed herein, and the dielectric constant at the surface of the sphere may be 1, substantially equal to the dielectric constant of air, or any other value suitable for a purpose disclosed herein. In an embodiment, the sphere of dielectric material 400 comprises a plurality of layers of dielectric materials, depicted and denoted in FIG. 1B and FIG. 4 as concentric rings 402 disposed around a central inner sphere, having different dielectric constants that decrease successively from the center of the sphere to the surface of the sphere. For example, the number of layers of dielectric materials may be 2, 3, 4, 5, or any other number suitable for a purpose disclosed herein. In an embodiment, the sphere of dielectric material 400 has a dielectric constant of 1 at the surface of the sphere. In an embodiment, the sphere of dielectric material 400 has a varying dielectric constant from the center of the sphere to the outer surface of the sphere that varies according to a defined function. In an embodiment, the diameter of the sphere of dielectric material 400 is equal to or less than 20 millimeters (mm). Alternatively, the diameter of the sphere of dielectric material 400 may be greater than 20 mm, as the collimation of the far field radiation pattern increases as the diameter of the sphere of dielectric material 400 increases.

With reference particularly to FIG. 4, in an embodiment where the EM beam shaper 104 comprises a sphere of dielectric material 400, each DRA 200 may be at least partially embedded in the sphere of dielectric material 400, which is depicted in FIG. 4 where the DRA 200 is embedded in the first and second layers 402.1, 402.2, but not in the third layer 402.3.

Figure 5A:
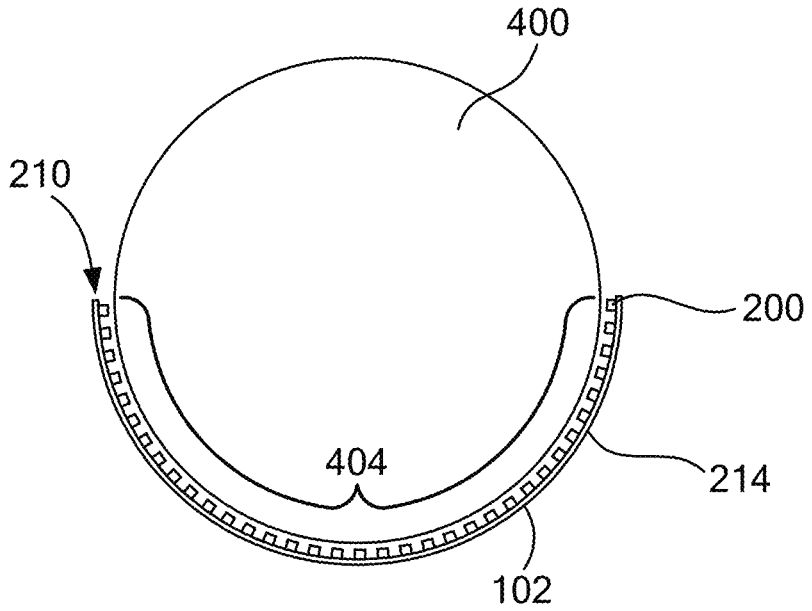
FIG. 5A depicts an elevation view cross section of an example electromagnetic device useful for building a high gain DRA system having an array of DRAs disposed in a non-planar arrangement at least partially around the surface of a spherical lens, in accordance with an embodiment.

With reference now to FIG. 5A, in an embodiment where the EM beam shaper 104 comprises a sphere of dielectric material 400 and the at least one DRA 200 comprises an array of the at least one DRA 200 to form an array of DRAs 210, the array of DRAs 210 may be disposed on a non-planar substrate 214 and disposed at least partially around the outer surface 404 of the sphere of dielectric material 400, and where as previously noted the sphere of dielectric material may more generally be a body of dielectric material. In an embodiment, the non-planar substrate 214 is integrally formed with the ground structure 102. In an embodiment, the at least one DRA 200 may be disposed on a curved or flexible substrate, such as a flexible printed circuit board for example, and may be arranged integral with the lens 400, which may be a Luneburg lens for example. In view of FIG. 5A, it will be appreciated that an embodiment includes an array of DRAs 210 that are disposed at least partially around the outer surface of the body of dielectric material 400 in a concave arrangement.

Figure 6:
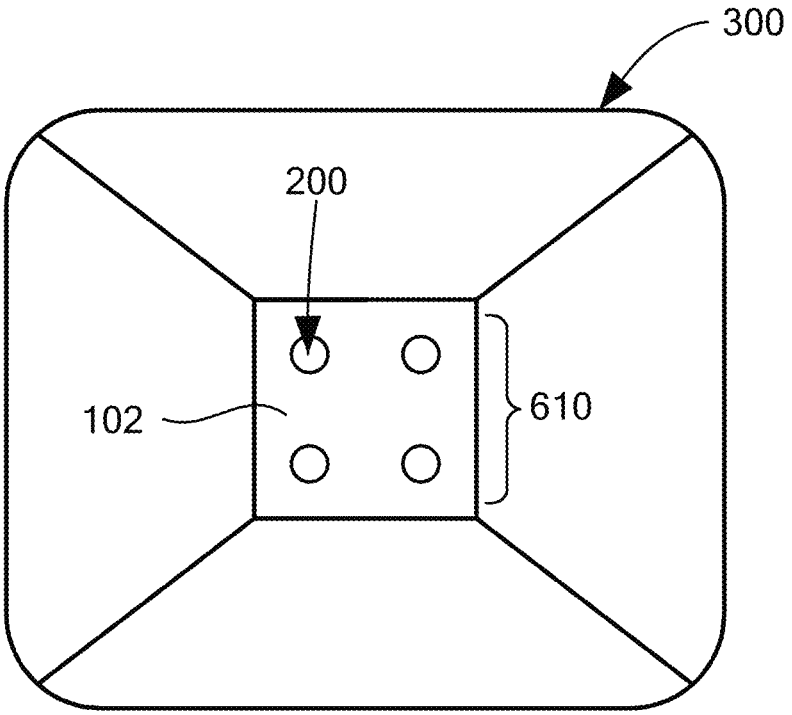
FIG. 6 depicts a plan view cross section of an example electromagnetic device useful for building a high gain DRA system having an array of DRAs disposed within an electromagnetic horn, in accordance with an embodiment.

While FIG. 5A depicts a one-dimensional array of DRAs 210 associated with a sphere of dielectric material 400, it will be appreciated that the scope of the invention is not so limited and also encompasses a two-dimensional array of DRAs, which may be associated with a sphere of dielectric material 400, or with an electrically conductive horn 300. For example and with reference to FIG. 6, in an embodiment where the EM beam shaper 104 comprises an electrically conductive horn 300 and the at least one DRA 200 comprises an array of the at least one DRA 200 to form an array of DRAs 610, the array of DRAs 610 may be disposed within the electrically conductive horn 300 on the ground structure 102. Alternatively and while not explicitly illustrated, it will be appreciated that a two-dimensional array of DRAs may be disposed on the non-planar substrate 214 and arranged integral with the lens 400. That is, the array of DRAs 210 depicted in FIG. 5A is representative of both a one-dimensional array of DRAs and a two-dimensional array of DRAs.

Figure 5B:
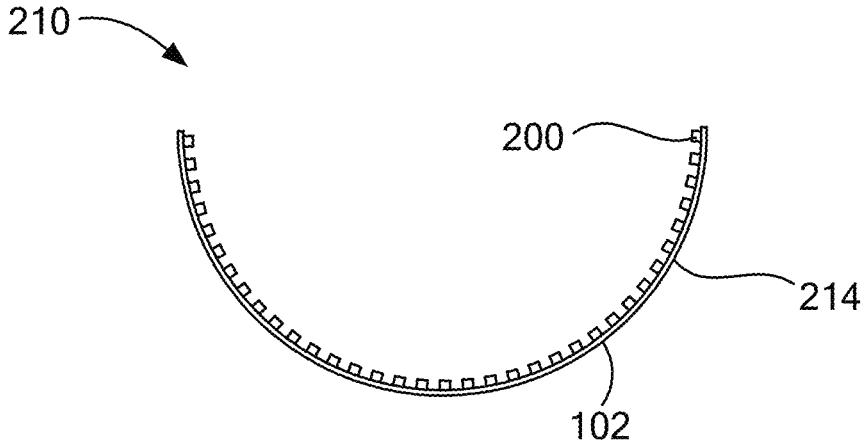
FIG. 5B depicts an elevation view cross section of an example electromagnetic device useful for building a high gain DRA system having an array of DRAs disposed on a concave curvature of a non-planar substrate, in accordance with an embodiment.
Figure 5C:
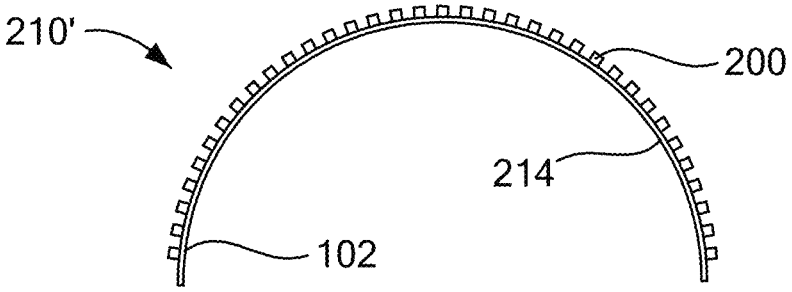
FIG. 5C depicts an elevation view cross section of an example electromagnetic device useful for building a high gain DRA system having an array of DRAs disposed on a convex curvature of a non-planar substrate, in accordance with an embodiment.

With reference now to FIGS. 5B and 5C as compared with FIG. 5A, it will be appreciated that an embodiment includes an array of DRAs 210, 210' where the DRAs 200 are disposed on the ground structure 102, and the ground structure 102 is disposed on a non-planar substrate 214, absent the foregoing described body or sphere of dielectric material 400. In an embodiment, the array of DRAs 210 are disposed on a concave curvature of the non-planar substrate 214 (best seen with reference to FIG. 5B), absent the foregoing described body or sphere of dielectric material 400. In an embodiment, the array of DRAs 210' are disposed on a convex curvature of the non-planar substrate 214 (best seen with reference to FIG. 5C), absent the foregoing described body or sphere of dielectric material 400. In an antenna embodiment operating on a non-planar substrate, the individual signal feeds to the respective DRAs may be phase delayed in order to compensate for the curvature of the antenna substrate.

As noted herein above, the at least one DRA 200 may be singly fed, selectively fed, or multiply fed by one or more signal feeds 106, which in an embodiment may be any type of signal feed suitable for a purpose disclosed herein, such as a coaxial cable with a vertical wire extension, to achieve extremely broad bandwidths, or via a microstrip with slotted aperture, a waveguide, or a surface integrated waveguide, for example. The signal feed may also include a semiconductor chip feed. In an embodiment, each DRA 200 of the array of DRAs 210, 610 is separately fed by a corresponding one of the at least one signal feed 106 to provide a multi-beam antenna. Alternatively, each DRA 200 of the array of DRAs 210, 610 is selectably fed by a single signal feed 106 to provide a steerable multi-beam antenna. As used herein, the term "multi-beam" encompasses an arrangement where there is only one DRA feed, an arrangement where the DRA system can steer the beam by selecting which DRA is fed via the signal feed, and an arrangement where the DRA system can feed multiple DRAs and to produce multiple beams oriented in different directions.

While embodiments may be described herein as being transmitter antenna systems, it will be appreciated that the scope of the invention is not so limited and also encompasses receiver antenna systems.

Embodiments of the DRA arrays disclosed herein are configured to be operational at an operating frequency (f) and associated wavelength (λ). In some embodiments the center-to-center spacing (via the overall geometry of a given DRA) between closest adjacent pairs of the plurality of DRAs within a given DRA array may be equal to or less than λ, where λ is the operating wavelength of the DRA array in free space. In some embodiments the center-to-center spacing between closest adjacent pairs of the plurality of DRAs within a given DRA array may be equal to or less than λ and equal to or greater than λ/2. In some embodiments the center-to-center spacing between closest adjacent pairs of the plurality of DRAs within a given DRA array may be equal to or less than λ/2. For example, at λ for a frequency equal to 10 GHz, the spacing from the center of one DRA to the center of a closet adjacent DRA is equal to or less than about 30 mm, or is between about 15 mm to about 30 mm, or is equal to or less than about 15 mm.

Analytical results of mathematical models of various example embodiments of an electromagnetic device 100 as disclosed herein have exhibited improved performance as compared to other such devices not employing certain structure as disclosed herein, which will now be discussed with reference to FIGS. 7A, 7B, 8A, 8B, 8C and 8D.

Figure 7A:
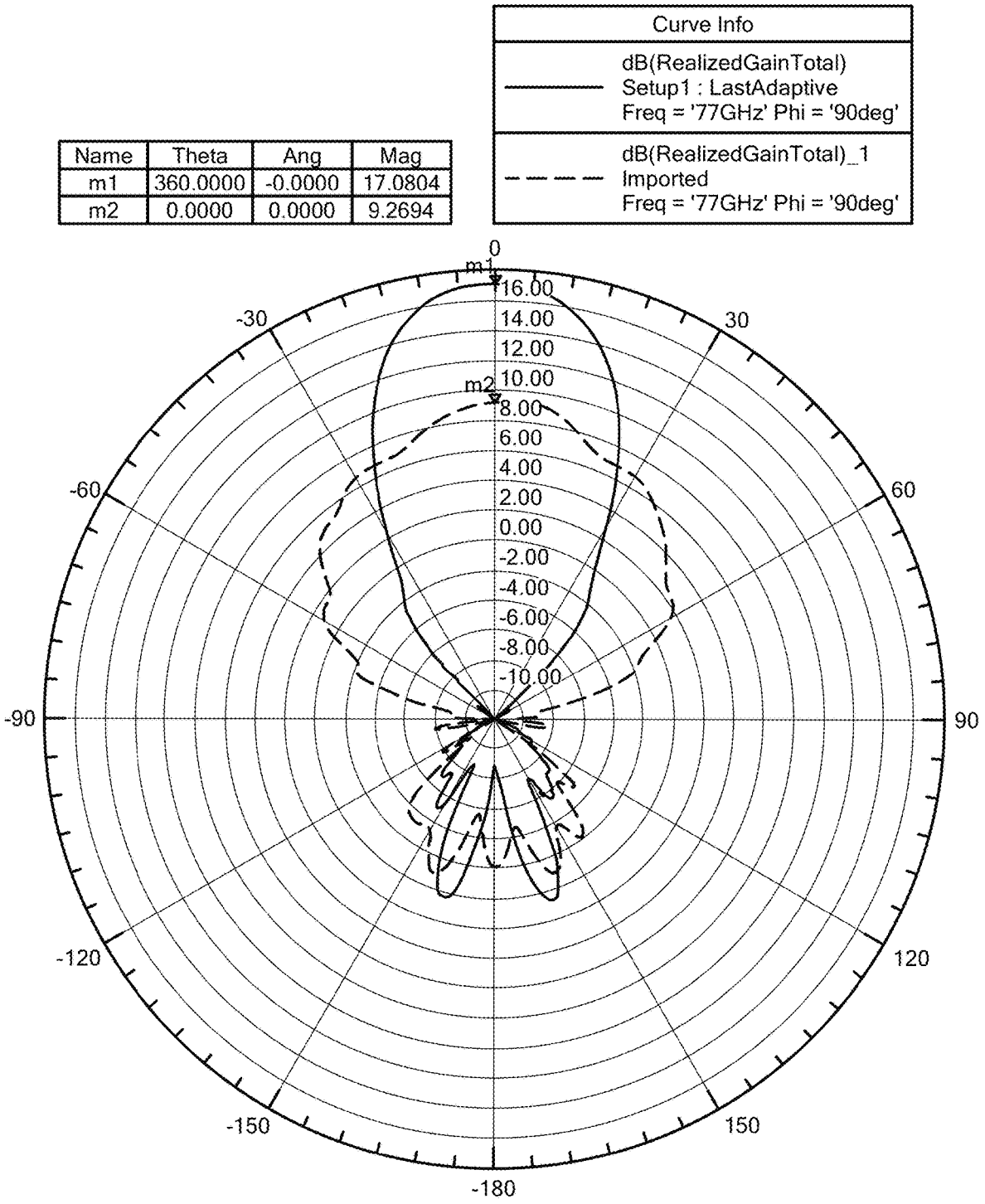
FIGS. 7A, 7B, 8A, 8B, 8C, 8D and 8E, depict analytical results of mathematical models of example embodiments disclosed herein, in accordance with an embodiment.
Figure 7B:
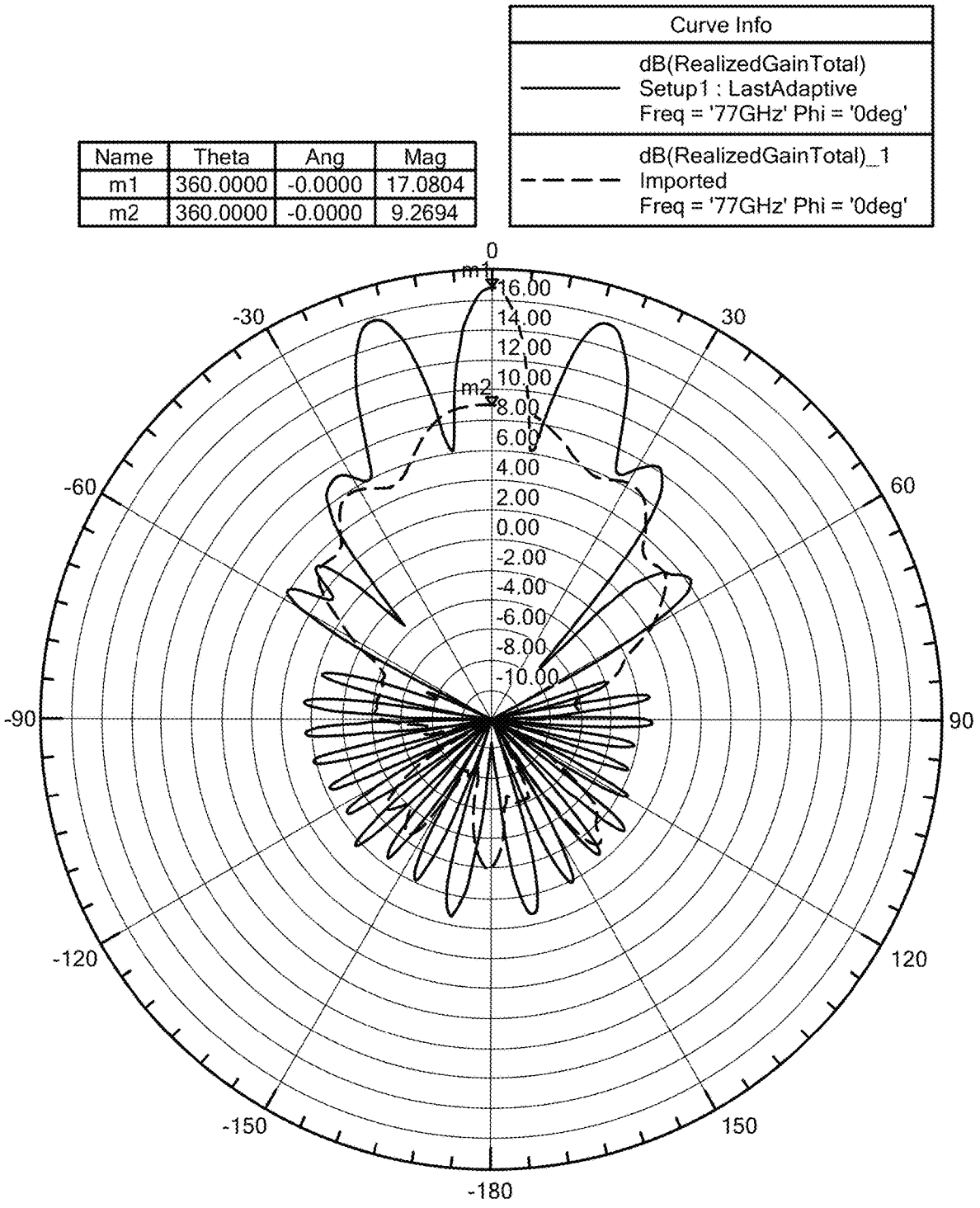

Regarding FIGS. 7A and 7B, the mathematical model analyzed here is representative of the embodiment depicted in FIGS. 3A and 3B, with and without the electrically conductive horn 300. FIGS. 7A and 7B depict realized gain total (dBi) of the far field radiation pattern in the y-z plane and the x-z plane, respectively, and compares the gain of a DRA system having an electrically conductive horn 300 (solid line plot) with the gain of a similar DRA system but absent the electrically conductive horn 300 (dashed line plot). As can be seen, the inclusion of an electrically conductive horn 300 with a DRA 200 as disclosed herein, produces analytical results that show an increase in far field gain from about 9.3 dBi to about 17.1 dBi in both the y-z plane and the x-z plane. The analytical results also exhibit a single-lobe radiation pattern in the y-z plane (FIG. 7A), while exhibiting a three-lobe radiation pattern in the x-z plane (FIG. 7B). Regarding such results, it is contemplated that use of a spherical lens as disclosed herein will not only improve the collimation of the far field radiation pattern (i.e., modify the three-lobe radiation pattern in the x-z plane to a more central single-lobe radiation pattern), but will also further improve the gain by about 6 dBi.

Regarding FIGS. 8A, 8B, 8C, 8D and 8E, the mathematical model analyzed here is representative of the embodiment depicted in FIG. 4, with and without the sphere of dielectric material 400 (e.g., dielectric lens), and absent an electrically conductive horn 300.

Figure 8A:
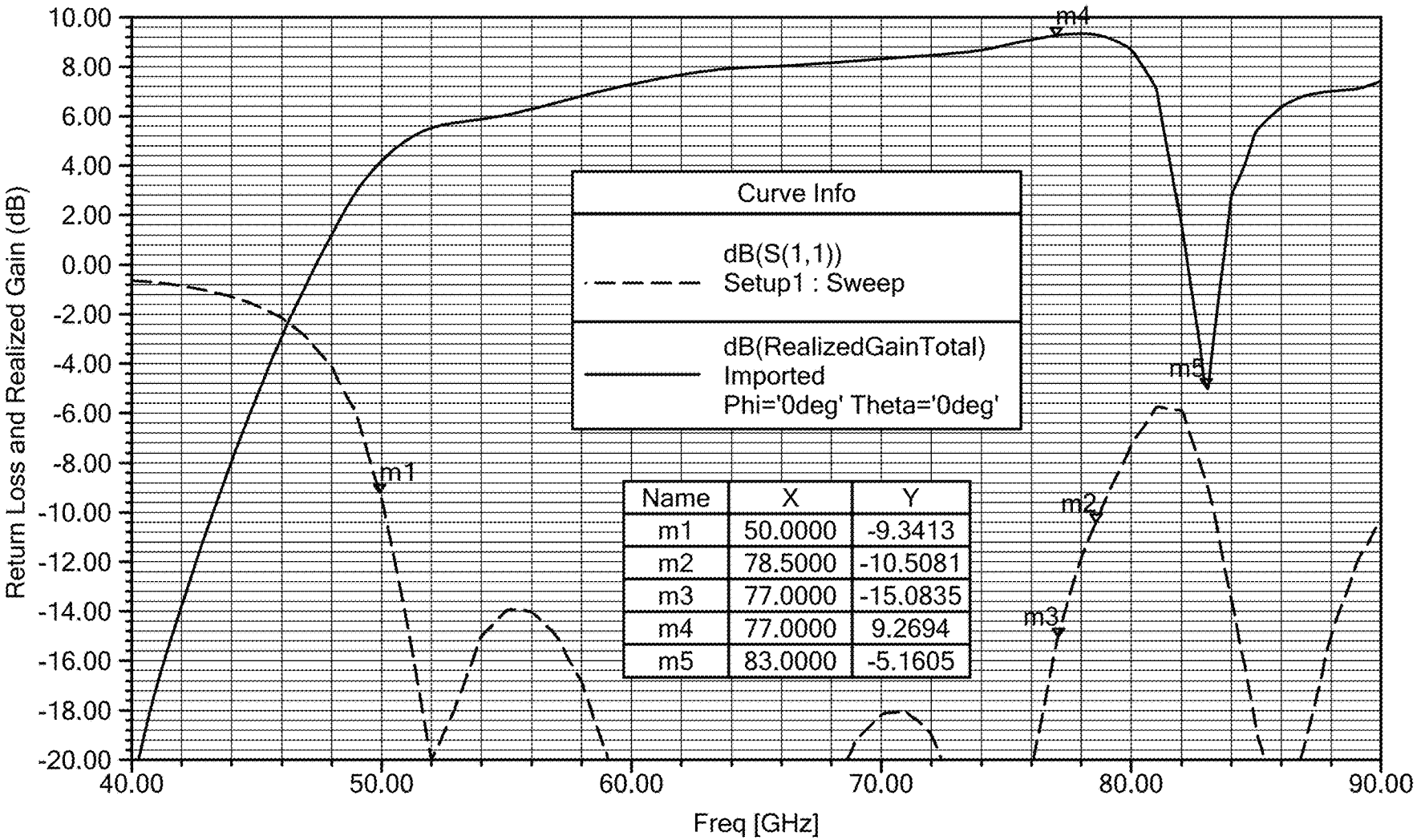

FIG. 8A depicts the return loss (dashed line plot) and realized gain total (dBi) (solid line plot) from 40 GHz to 90 GHz excitation of an embodiment of FIG. 4, but absent a dielectric lens 400 as a bench mark. As can be seen, the bench mark of realized gain total absent a dielectric lens 400 is about 9.3 dBi at 77 GHz. Markers m1, m2, m3, m4 and m5 are depicted with corresponding x (frequency) and y (gain) coordinates. TE radiating modes were found to occur between about 49 GHz and about 78 GHz. A quasi TM radiating mode was found to occur around 80 GHz.

Figure 8B:
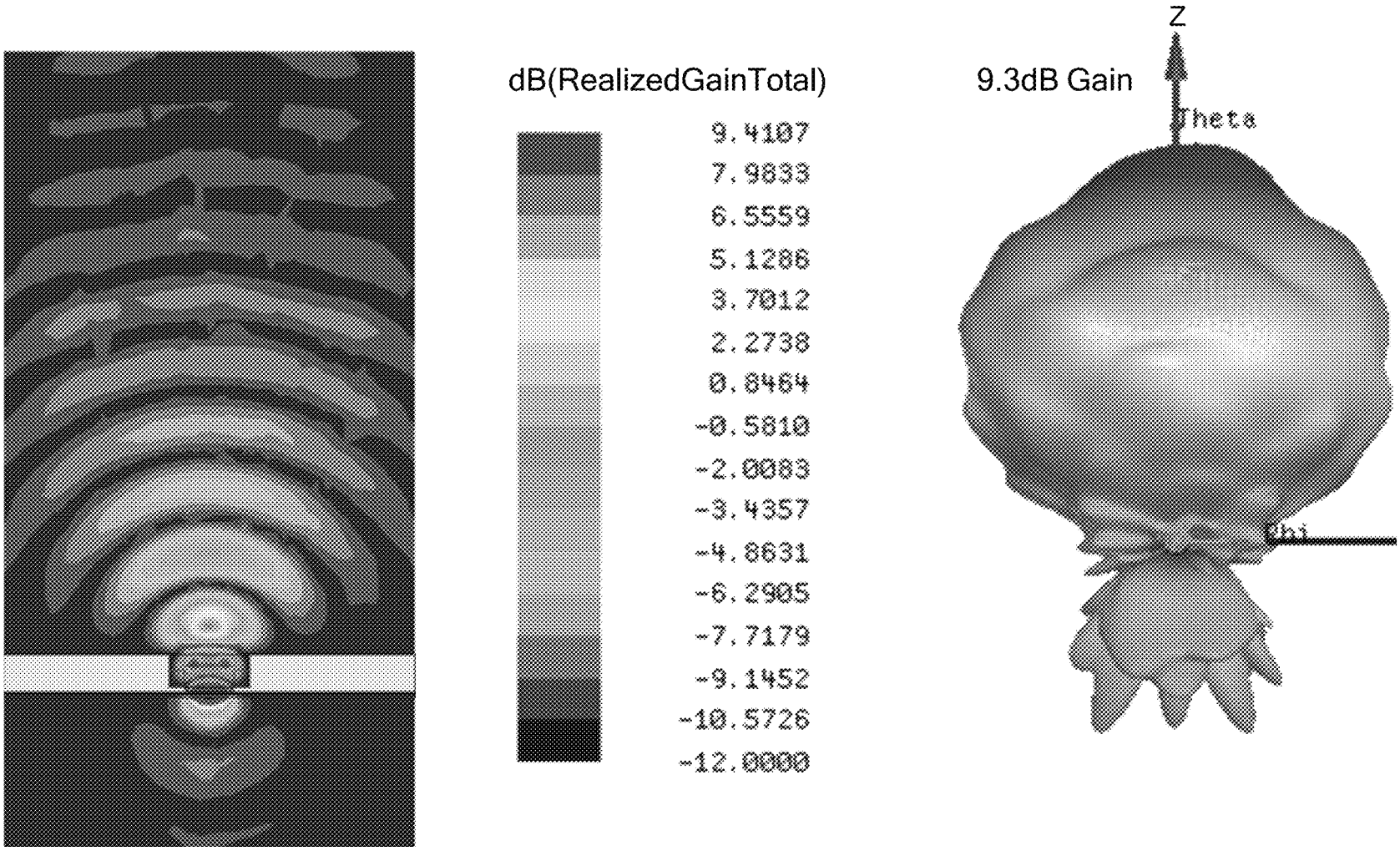
Figure 8C:
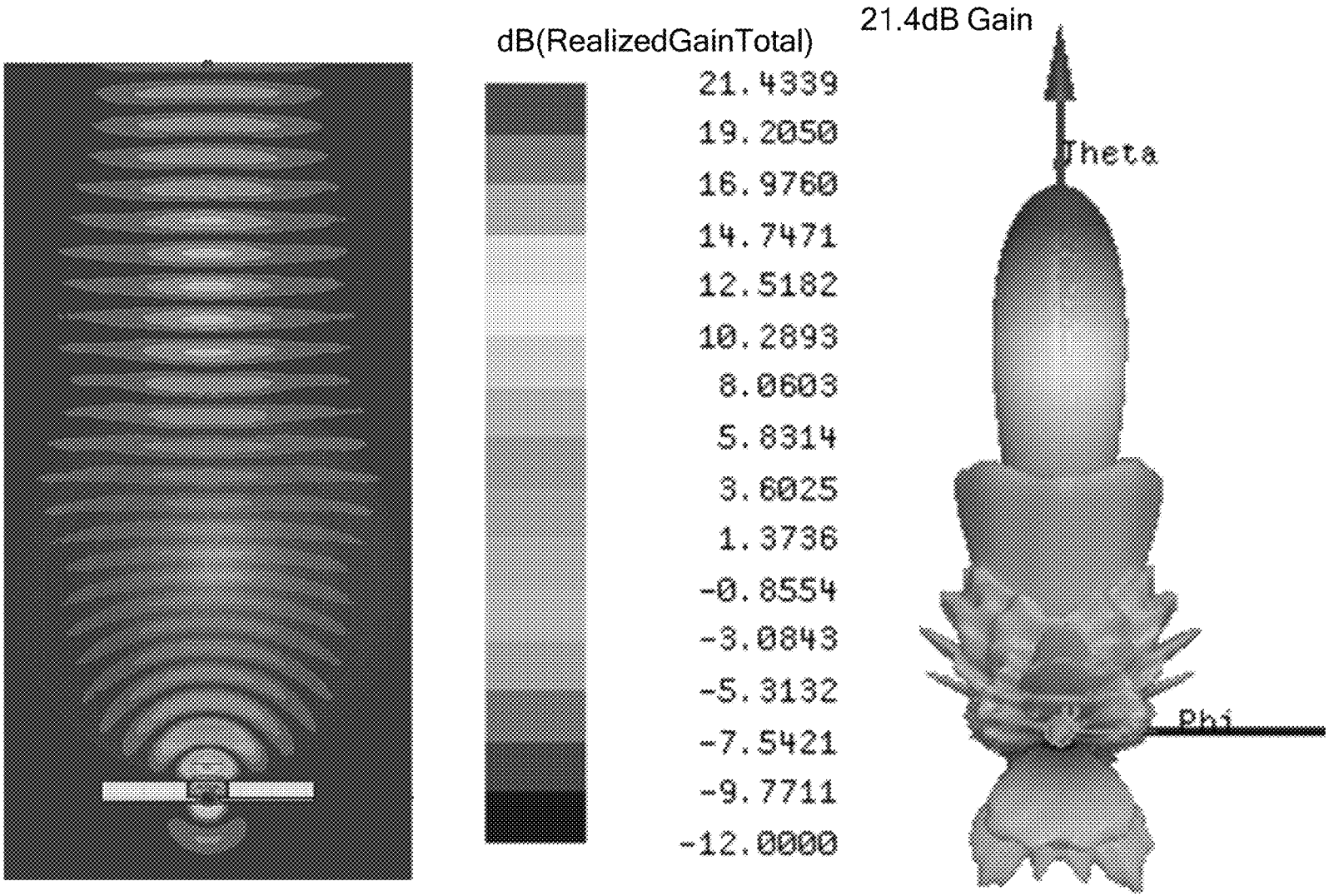

FIGS. 8B and 8C depict realized gain total (dBi) of the far field radiation pattern without a dielectric lens 400 and with a dielectric lens 400, respectively, at 77 GHz, and shows an increase of realized gain total from about 9.3 dBi to about 21.4 dBi with the inclusion of the dielectric lens 400 in the DRA system.

Figure 8D:
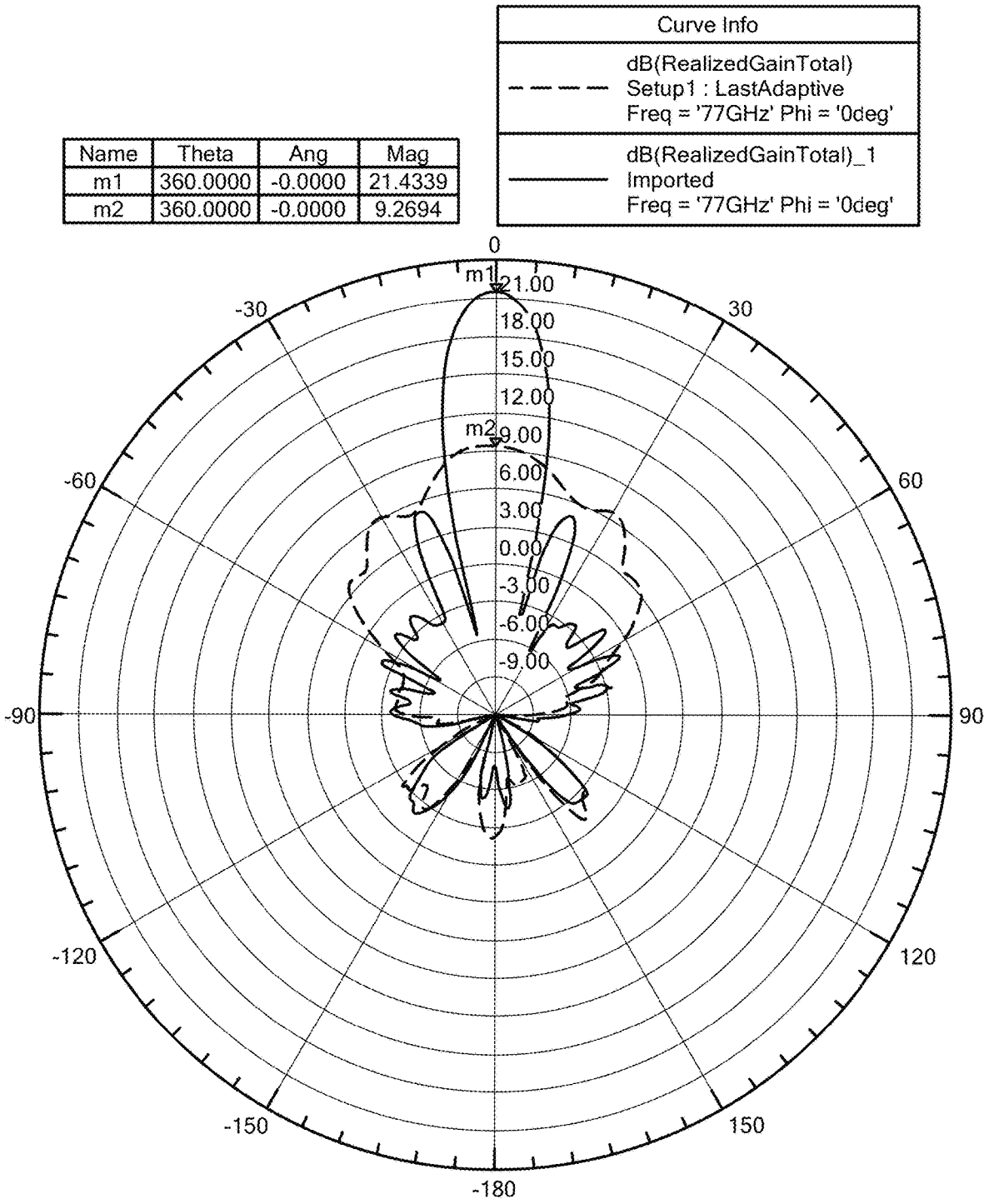
Figure 8E:
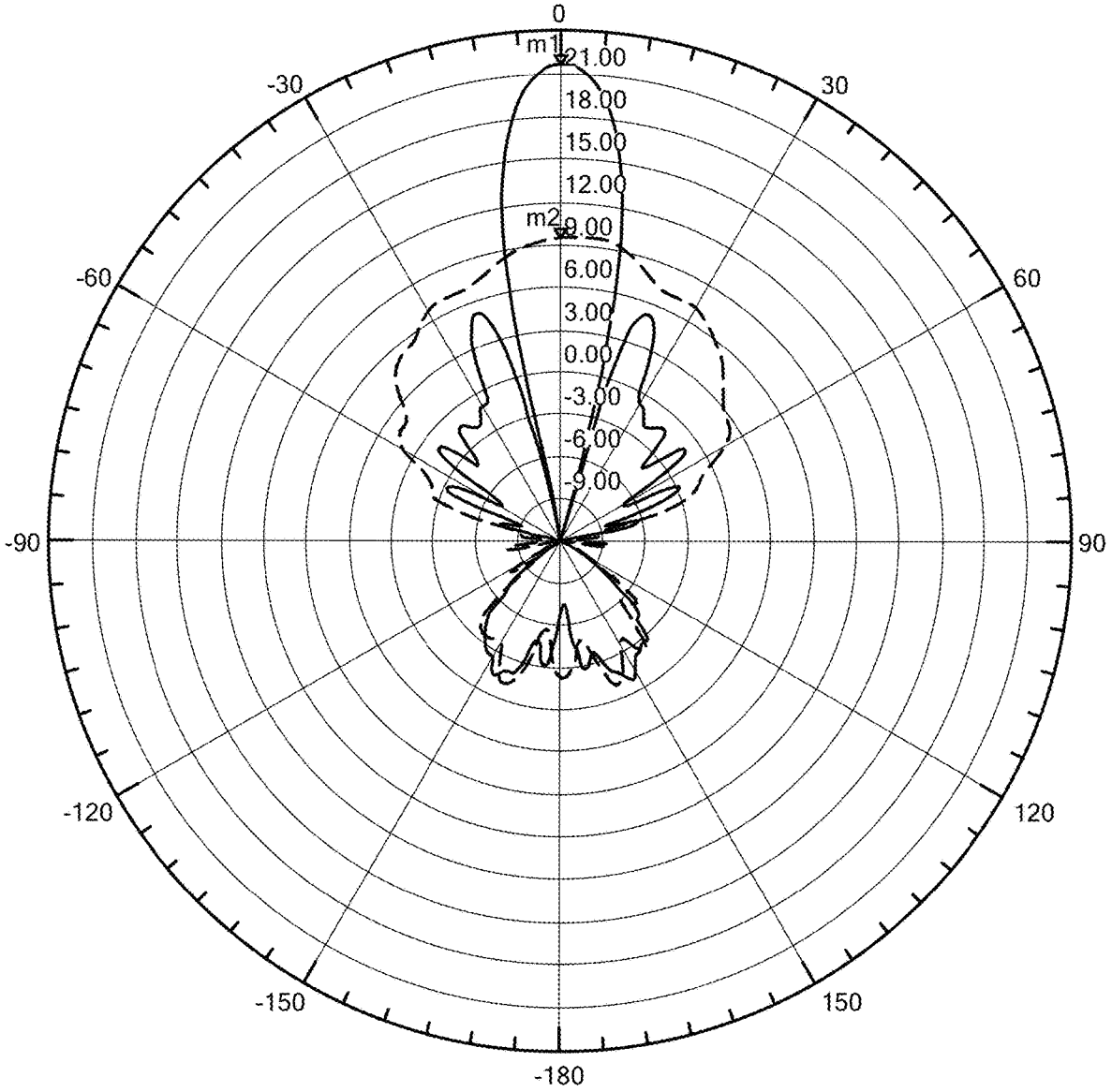

FIGS. 8D and 8E depict realized gain total (dBi) of the far field radiation pattern in the y-z plane and the x-z plane, respectively, and compares the gain of a DRA system with a dielectric lens 400 of 20 millimeter diameter (solid line plot) with the gain of a similar DRA system but without the dielectric lens 400 (dashed line plot). As can be seen, the inclusion of a dielectric lens 400 with a DRA 200 as disclosed herein, produces analytical results that show an increase in far field gain from about 9.3 dBi to about 21.4 dBi in both the y-z plane and the x-z plane.

The dielectric materials for use herein are selected to provide the desired electrical and mechanical properties for a purpose disclosed herein. The dielectric materials generally comprise a thermoplastic or thermosetting polymer matrix and a filler composition containing a dielectric filler. The dielectric volume can comprise, based on the volume of the dielectric volume, 30 to 100 volume percent (vol %) of a polymer matrix, and 0 to 70 vol % of a filler composition, specifically 30 to 99 vol % of a polymer matrix and 1 to 70 vol % of a filler composition, more specifically 50 to 95 vol % of a polymeric matrix and 5 to 50 vol % of a filler composition. The polymer matrix and the filler are selected to provide a dielectric volume having a dielectric constant consistent for a purpose disclosed herein and a dissipation factor of less than 0.006, specifically, less than or equal to 0.0035 at 10 GigaHertz (GHz). The dissipation factor can be measured by the IPC-TM-650 X-band strip line method or by the Split Resonator method.

The dielectric volume comprises a low polarity, low dielectric constant, and low loss polymer. The polymer can comprise 1,2-polybutadiene (PBD), polyisoprene, polybutadiene-polyisoprene copolymers, polyetherimide (PEI), fluoropolymers such as polytetrafluoroethylene (PTFE), polyimide, polyetheretherketone (PEEK), polyamidimide, polyethylene terephthalate (PET), polyethylene naphthalate, polycyclohexylene terephthalate, polyphenylene ethers, those based on allylated polyphenylene ethers, or a combination comprising at least one of the foregoing. Combinations of low polarity polymers with higher polarity polymers can also be used, non-limiting examples including epoxy and poly(phenylene ether), epoxy and poly(etherimide), cyanate ester and poly(phenylene ether), and 1,2-polybutadiene and polyethylene.

Fluoropolymers include fluorinated homopolymers, e.g., PTFE and polychlorotrifluoroethylene (PCTFE), and fluorinated copolymers, e.g. copolymers of tetrafluoroethylene or chlorotrifluoroethylene with a monomer such as hexafluoropropylene or perfluoroalkylvinylethers, vinylidene fluoride, vinyl fluoride, ethylene, or a combination comprising at least one of the foregoing. The fluoropolymer can comprise a combination of different at least one these fluoropolymers.

The polymer matrix can comprise thermosetting polybutadiene or polyisoprene. As used herein, the term "thermosetting polybutadiene or polyisoprene" includes homopolymers and copolymers comprising units derived from butadiene, isoprene, or combinations thereof. Units derived from other copolymerizable monomers can also be present in the polymer, for example, in the form of grafts. Exemplary copolymerizable monomers include, but are not limited to, vinylaromatic monomers, for example substituted and unsubstituted monovinylaromatic monomers such as styrene, 3-methylstyrene, 3,5-diethylstyrene, 4-n-propylstyrene, alpha-methylstyrene, alpha-methyl vinyltoluene, para-hydroxystyrene, para-methoxystyrene, alpha-chlorostyrene, alpha-bromostyrene, dichlorostyrene, dibromostyrene, tetrachlorostyrene, and the like; and substituted and unsubstituted divinylaromatic monomers such as divinylbenzene, divinyltoluene, and the like. Combinations comprising at least one of the foregoing copolymerizable monomers can also be used. Exemplary thermosetting polybutadiene or polyisoprenes include, but are not limited to, butadiene homopolymers, isoprene homopolymers, butadiene-vinylaromatic copolymers such as butadiene-styrene, isoprene-vinylaromatic copolymers such as isoprene-styrene copolymers, and the like.

The thermosetting polybutadiene or polyisoprenes can also be modified. For example, the polymers can be hydroxyl-terminated, methacrylate-terminated, carboxylate-terminated, or the like. Post-reacted polymers can be used, such as epoxy-, maleic anhydride-, or urethane-modified polymers of butadiene or isoprene polymers. The polymers can also be crosslinked, for example by divinylaromatic compounds such as divinyl benzene, e.g., a polybutadiene-styrene crosslinked with divinyl benzene. Exemplary materials are broadly classified as "polybutadienes" by their manufacturers, for example, Nippon Soda Co., Tokyo, Japan, and Cray Valley Hydrocarbon Specialty Chemicals, Exton, Pa. Combinations can also be used, for example, a combination of a polybutadiene homopolymer and a poly (butadiene-isoprene) copolymer. Combinations comprising a syndiotactic polybutadiene can also be useful.

The thermosetting polybutadiene or polyisoprene can be liquid or solid at room temperature. The liquid polymer can have a number average molecular weight (Mn) of greater than or equal to 5,000 g/mol. The liquid polymer can have an Mn of less than 5,000 g/mol, specifically, 1,000 to 3,000 g/mol. Thermosetting polybutadiene or polyisoprenes having at least 90 wt % 1,2 addition, which can exhibit greater crosslink density upon cure due to the large number of pendent vinyl groups available for crosslinking.

The polybutadiene or polyisoprene can be present in the polymer composition in an amount of up to 100 wt %, specifically, up to 75 wt % with respect to the total polymer matrix composition, more specifically, 10 to 70 wt %, even more specifically, 20 to 60 or 70 wt %, based on the total polymer matrix composition.

Other polymers that can co-cure with the thermosetting polybutadiene or polyisoprenes can be added for specific property or processing modifications. For example, in order to improve the stability of the dielectric strength and mechanical properties of the dielectric material over time, a lower molecular weight ethylene-propylene elastomer can be used in the systems. An ethylene-propylene elastomer as used herein is a copolymer, terpolymer, or other polymer comprising primarily ethylene and propylene. Ethylene-propylene elastomers can be further classified as EPM copolymers (i.e., copolymers of ethylene and propylene monomers) or EPDM terpolymers (i.e., terpolymers of ethylene, propylene, and diene monomers). Ethylene-propylene-diene terpolymer rubbers, in particular, have saturated main chains, with unsaturation available off the main chain for facile cross-linking. Liquid ethylene-propylene-diene terpolymer rubbers, in which the diene is dicyclopentadiene, can be used.

The molecular weights of the ethylene-propylene rubbers can be less than 10,000 g/mol viscosity average molecular weight (Mv). The ethylene-propylene rubber can include an ethylene-propylene rubber having an Mv of 7,200 g/mol, which is available from Lion Copolymer, Baton Rouge, La., under the trade name TRILENE™ CP80; a liquid ethylene-propylene-dicyclopentadiene terpolymer rubbers having an Mv of 7,000 g/mol, which is available from Lion Copolymer under the trade name of TRILENE™ 65; and a liquid ethylene-propylene-ethylidene norbornene terpolymer having an Mv of 7,500 g/mol, which is available from Lion Copolymer under the name TRILENE™ 67.

The ethylene-propylene rubber can be present in an amount effective to maintain the stability of the properties of the dielectric material over time, in particular the dielectric strength and mechanical properties. Typically, such amounts are up to 20 wt % with respect to the total weight of the polymer matrix composition, specifically, 4 to 20 wt %, more specifically, 6 to 12 wt %.

Another type of co-curable polymer is an unsaturated polybutadiene- or polyisoprene-containing elastomer. This component can be a random or block copolymer of primarily 1,3-addition butadiene or isoprene with an ethylenically unsaturated monomer, for example, a vinylaromatic compound such as styrene or alpha-methyl styrene, an acrylate or methacrylate such a methyl methacrylate, or acrylonitrile. The elastomer can be a solid, thermoplastic elastomer comprising a linear or graft-type block copolymer having a polybutadiene or polyisoprene block and a thermoplastic block that can be derived from a monovinylaromatic monomer such as styrene or alpha-methyl styrene. Block copolymers of this type include styrene-butadiene-styrene triblock copolymers, for example, those available from Dexco Polymers, Houston, Tex. under the trade name VECTOR 8508M™, from Enichem Elastomers America, Houston, Tex. under the trade name SOL-T-6302™, and those from Dynasol Elastomers under the trade name CALPRENE™ 401; and styrene-butadiene diblock copolymers and mixed triblock and diblock copolymers containing styrene and butadiene, for example, those available from Kraton Polymers (Houston, Tex.) under the trade name KRATON D1118. KRATON D1118 is a mixed diblock/triblock styrene and butadiene containing copolymer that contains 33 wt % styrene.

The optional polybutadiene- or polyisoprene-containing elastomer can further comprise a second block copolymer similar to that described above, except that the polybutadiene or polyisoprene block is hydrogenated, thereby forming a polyethylene block (in the case of polybutadiene) or an ethylene-propylene copolymer block (in the case of polyisoprene). When used in conjunction with the above-described copolymer, materials with greater toughness can be produced. An exemplary second block copolymer of this type is KRATON GX1855 (commercially available from Kraton Polymers, which is believed to be a combination of a styrene-high 1,2-butadiene-styrene block copolymer and a styrene-(ethylene-propylene)-styrene block copolymer.

The unsaturated polybutadiene- or polyisoprene-containing elastomer component can be present in the polymer matrix composition in an amount of 2 to 60 wt % with respect to the total weight of the polymer matrix composition, specifically, 5 to 50 wt %, more specifically, 10 to 40 or 50 wt %.

Still other co-curable polymers that can be added for specific property or processing modifications include, but are not limited to, homopolymers or copolymers of ethylene such as polyethylene and ethylene oxide copolymers; natural rubber; norbornene polymers such as polydicyclopentadiene; hydrogenated styrene-isoprene-styrene copolymers and butadiene-acrylonitrile copolymers; unsaturated polyesters; and the like. Levels of these copolymers are generally less than 50 wt % of the total polymer in the polymer matrix composition.

Free radical-curable monomers can also be added for specific property or processing modifications, for example to increase the crosslink density of the system after cure. Exemplary monomers that can be suitable crosslinking agents include, for example, di, tri-, or higher ethylenically unsaturated monomers such as divinyl benzene, triallyl cyanurate, diallyl phthalate, and multifunctional acrylate monomers (e.g., SARTOMER™ polymers available from Sartomer USA, Newtown Square, Pa.), or combinations thereof, all of which are commercially available. The crosslinking agent, when used, can be present in the polymer matrix composition in an amount of up to 20 wt %, specifically, 1 to 15 wt %, based on the total weight of the total polymer in the polymer matrix composition.

A curing agent can be added to the polymer matrix composition to accelerate the curing reaction of polyenes having olefinic reactive sites. Curing agents can comprise organic peroxides, for example, dicumyl peroxide, t-butyl perbenzoate, 2,5-dimethyl-2,5-di(t-butyl peroxy)hexane, α,α-di-bis(t-butyl peroxy)diisopropylbenzene, 2,5-dimethyl-2,5-di(t-butyl peroxy) hexyne-3, or a combination comprising at least one of the foregoing. Carbon-carbon initiators, for example, 2,3-dimethyl-2,3 diphenylbutane can be used. Curing agents or initiators can be used alone or in combination. The amount of curing agent can be 1.5 to 10 wt % based on the total weight of the polymer in the polymer matrix composition.

In some embodiments, the polybutadiene or polyisoprene polymer is carboxy-functionalized. Functionalization can be accomplished using a polyfunctional compound having in the molecule both (i) a carbon-carbon double bond or a carbon-carbon triple bond, and (ii) at least one of a carboxy group, including a carboxylic acid, anhydride, amide, ester, or acid halide. A specific carboxy group is a carboxylic acid or ester. Examples of polyfunctional compounds that can provide a carboxylic acid functional group include maleic acid, maleic anhydride, fumaric acid, and citric acid. In particular, polybutadienes adducted with maleic anhydride can be used in the thermosetting composition. Suitable maleinized polybutadiene polymers are commercially available, for example from Cray Valley under the trade names RICON 130MA8, RICON 130MA13, RICON 130MA20, RICON 131MA5, RICON 131MA10, RICON 131MA17, RICON 131MA20, and RICON 156MA17. Suitable maleinized polybutadiene-styrene copolymers are commercially available, for example, from Sartomer under the trade names RICON 184MA6. RICON 184MA6 is a butadiene-styrene copolymer adducted with maleic anhydride having styrene content of 17 to 27 wt % and Mn of 9,900 g/mol.

The relative amounts of the various polymers in the polymer matrix composition, for example, the polybutadiene or polyisoprene polymer and other polymers, can depend on the particular conductive metal ground plate layer used, the desired properties of the circuit materials, and like considerations. For example, use of a poly(arylene ether) can provide increased bond strength to a conductive metal component, for example, a copper or aluminum component such as a signal feed, ground, or reflector component. Use of a polybutadiene or polyisoprene polymer can increase high temperature resistance of the composites, for example, when these polymers are carboxy-functionalized. Use of an elastomeric block copolymer can function to compatibilize the components of the polymer matrix material. Determination of the appropriate quantities of each component can be done without undue experimentation, depending on the desired properties for a particular application.

The dielectric volume can further include a particulate dielectric filler selected to adjust the dielectric constant, dissipation factor, coefficient of thermal expansion, and other properties of the dielectric volume. The dielectric filler can comprise, for example, titanium dioxide (rutile and anatase), barium titanate, strontium titanate, silica (including fused amorphous silica), corundum, wollastonite, $Ba_2Ti_9O_{20}$, solid glass spheres, synthetic glass or ceramic hollow spheres, quartz, boron nitride, aluminum nitride, silicon carbide, beryllia, alumina, alumina trihydrate, magnesia, mica, talcs, nanoclays, magnesium hydroxide, or a combination comprising at least one of the foregoing. A single secondary filler, or a combination of secondary fillers, can be used to provide a desired balance of properties.

Optionally, the fillers can be surface treated with a silicon-containing coating, for example, an organofunctional alkoxy silane coupling agent. A zirconate or titanate coupling agent can be used. Such coupling agents can improve the dispersion of the filler in the polymeric matrix and reduce water absorption of the finished DRA. The filler component can comprise 5 to 50 vol % of the microspheres and 70 to 30 vol % of fused amorphous silica as secondary filler based on the weight of the filler.

The dielectric volume can also optionally contain a flame retardant useful for making the volume resistant to flame. These flame retardant can be halogenated or unhalogenated. The flame retardant can be present in in the dielectric volume in an amount of 0 to 30 vol % based on the volume of the dielectric volume.

In an embodiment, the flame retardant is inorganic and is present in the form of particles. An exemplary inorganic flame retardant is a metal hydrate, having, for example, a volume average particle diameter of 1 nm to 500 nm, preferably 1 to 200 nm, or 5 to 200 nm, or 10 to 200 nm; alternatively the volume average particle diameter is 500 nm to 15 micrometer, for example 1 to 5 micrometer. The metal hydrate is a hydrate of a metal such as Mg, Ca, Al, Fe, Zn, Ba, Cu, Ni, or a combination comprising at least one of the foregoing. Hydrates of Mg, Al, or Ca are particularly preferred, for example aluminum hydroxide, magnesium hydroxide, calcium hydroxide, iron hydroxide, zinc hydroxide, copper hydroxide and nickel hydroxide; and hydrates of calcium aluminate, gypsum dihydrate, zinc borate and barium metaborate. Composites of these hydrates can be used, for example a hydrate containing Mg and one or more of Ca, Al, Fe, Zn, Ba, Cu and Ni. A preferred composite metal hydrate has the formula $MgMx.(OH)_y$ wherein M is Ca, Al, Fe, Zn, Ba, Cu, or Ni, x is 0.1 to 10, and y is from 2 to 32. The flame retardant particles can be coated or otherwise treated to improve dispersion and other properties.

Organic flame retardants can be used, alternatively or in addition to the inorganic flame retardants. Examples of inorganic flame retardants include melamine cyanurate, fine particle size melamine polyphosphate, various other phosphorus-containing compounds such as aromatic phosphinates, diphosphinates, phosphonates, and phosphates, certain polysilsesquioxanes, siloxanes, and halogenated compounds such as hexachloroendomethylenetetrahydrophthalic acid (HET acid), tetrabromophthalic acid and dibromoneopentyl glycol A flame retardant (such as a bromine-containing flame retardant) can be present in an amount of 20 phr (parts per hundred parts of resin) to 60 phr, specifically, 30 to 45 phr. Examples of brominated flame retardants include Saytex BT93W (ethylene bistetrabromophthalimide), Saytex 120 (tetradecabromodiphenoxy benzene), and Saytex 102 (decabromodiphenyl oxide). The flame retardant can be used in combination with a synergist, for example a halogenated flame retardant can be used in combination with a synergists such as antimony trioxide, and a phosphorus-containing flame retardant can be used in combination with a nitrogen-containing compound such as melamine.

The volume of dielectric material may be formed from a dielectric composition comprising the polymer matrix composition and the filler composition. The volume can be formed by casting a dielectric composition directly onto the ground structure layer, or a dielectric volume can be produced that can be deposited onto the ground structure layer. The method to produce the dielectric volume can be based on the polymer selected. For example, where the polymer comprises a fluoropolymer such as PTFE, the polymer can be mixed with a first carrier liquid. The combination can comprise a dispersion of polymeric particles in the first carrier liquid, e.g., an emulsion of liquid droplets of the polymer or of a monomeric or oligomeric precursor of the polymer in the first carrier liquid, or a solution of the polymer in the first carrier liquid. If the polymer is liquid, then no first carrier liquid may be necessary.

The choice of the first carrier liquid, if present, can be based on the particular polymeric and the form in which the polymeric is to be introduced to the dielectric volume. If it is desired to introduce the polymeric as a solution, a solvent for the particular polymer is chosen as the carrier liquid, e.g., N-methyl pyrrolidone (NMP) would be a suitable carrier liquid for a solution of a polyimide. If it is desired to introduce the polymer as a dispersion, then the carrier liquid can comprise a liquid in which the is not soluble, e.g., water would be a suitable carrier liquid for a dispersion of PTFE particles and would be a suitable carrier liquid for an emulsion of polyamic acid or an emulsion of butadiene monomer.

The dielectric filler component can optionally be dispersed in a second carrier liquid, or mixed with the first carrier liquid (or liquid polymer where no first carrier is used). The second carrier liquid can be the same liquid or can be a liquid other than the first carrier liquid that is miscible with the first carrier liquid. For example, if the first carrier liquid is water, the second carrier liquid can comprise water or an alcohol. The second carrier liquid can comprise water.

The filler dispersion can comprise a surfactant in an amount effective to modify the surface tension of the second carrier liquid to enable the second carrier liquid to wet the borosilicate microspheres. Exemplary surfactant compounds include ionic surfactants and nonionic surfactants. TRITON X-100™, has been found to be an exemplary surfactant for use in aqueous filler dispersions. The filler dispersion can comprise 10 to 70 vol % of filler and 0.1 to 10 vol % of surfactant, with the remainder comprising the second carrier liquid.

The combination of the polymer and first carrier liquid and the filler dispersion in the second carrier liquid can be combined to form a casting mixture. In an embodiment, the casting mixture comprises 10 to 60 vol % of the combined polymer and filler and 40 to 90 vol % combined first and second carrier liquids. The relative amounts of the polymer and the filler component in the casting mixture can be selected to provide the desired amounts in the final composition as described below.

The viscosity of the casting mixture can be adjusted by the addition of a viscosity modifier, selected on the basis of its compatibility in a particular carrier liquid or combination of carrier liquids, to retard separation, i.e. sedimentation or flotation, of the hollow sphere filler from the dielectric composite material and to provide a dielectric composite material having a viscosity compatible with conventional manufacturing equipment. Exemplary viscosity modifiers suitable for use in aqueous casting mixtures include, e.g., polyacrylic acid compounds, vegetable gums, and cellulose based compounds. Specific examples of suitable viscosity modifiers include polyacrylic acid, methyl cellulose, polyethyleneoxide, guar gum, locust bean gum, sodium carboxymethylcellulose, sodium alginate, and gum tragacanth. The viscosity of the viscosity-adjusted casting mixture can be further increased, i.e., beyond the minimum viscosity, on an application by application basis to adapt the dielectric composite material to the selected manufacturing technique. In an embodiment, the viscosity-adjusted casting mixture can exhibit a viscosity of 10 to 100,000 centipoise (cp); specifically, 100 cp and 10,000 cp measured at room temperature value.

Alternatively, the viscosity modifier can be omitted if the viscosity of the carrier liquid is sufficient to provide a casting mixture that does not separate during the time period of interest. Specifically, in the case of extremely small particles, e.g., particles having an equivalent spherical diameter less than 0.1 micrometers, the use of a viscosity modifier may not be necessary.

A layer of the viscosity-adjusted casting mixture can be cast onto the ground structure layer, or can be dip-coated and then shaped. The casting can be achieved by, for example, dip coating, flow coating, reverse roll coating, knife-over-roll, knife-over-plate, metering rod coating, and the like.

The carrier liquid and processing aids, i.e., the surfactant and viscosity modifier, can be removed from the cast volume, for example, by evaporation or by thermal decomposition in order to consolidate a dielectric volume of the polymer and the filler comprising the microspheres.

The volume of the polymeric matrix material and filler component can be further heated to modify the physical properties of the volume, e.g., to sinter a thermoplastic or to cure or post cure a thermosetting composition.

In another method, a PTFE composite dielectric volume can be made by a paste extrusion and calendaring process.

In still another embodiment, the dielectric volume can be cast and then partially cured ("B-staged"). Such B-staged volumes can be stored and used subsequently.

An adhesion layer can be disposed between the conductive ground layer and the dielectric volume. The adhesion layer can comprise a poly(arylene ether); and a carboxy-functionalized polybutadiene or polyisoprene polymer comprising butadiene, isoprene, or butadiene and isoprene units, and zero to less than or equal to 50 wt % of co-curable monomer units; wherein the composition of the adhesive layer is not the same as the composition of the dielectric volume. The adhesive layer can be present in an amount of 2 to 15 grams per square meter. The poly(arylene ether) can comprise a carboxy-functionalized poly(arylene ether). The poly(arylene ether) can be the reaction product of a poly (arylene ether) and a cyclic anhydride or the reaction product of a poly(arylene ether) and maleic anhydride. The carboxy-functionalized polybutadiene or polyisoprene polymer can be a carboxy-functionalized butadiene-styrene copolymer. The carboxy-functionalized polybutadiene or polyisoprene polymer can be the reaction product of a polybutadiene or polyisoprene polymer and a cyclic anhydride. The carboxy-functionalized polybutadiene or polyisoprene polymer can be a maleinized polybutadiene-styrene or maleinized polyisoprene-styrene copolymer.

In an embodiment, a multiple-step process suitable for thermosetting materials such as polybutadiene or polyisoprene can comprise a peroxide cure step at temperatures of 150 to 200° C., and the partially cured (B-staged) stack can then be subjected to a high-energy electron beam irradiation cure (E-beam cure) or a high temperature cure step under an inert atmosphere. Use of a two-stage cure can impart an unusually high degree of cross-linking to the resulting composite. The temperature used in the second stage can be 250 to 300° C., or the decomposition temperature of the polymer. This high temperature cure can be carried out in an oven but can also be performed in a press, namely as a continuation of the initial fabrication and cure step. Particular fabrication temperatures and pressures will depend upon the particular adhesive composition and the dielectric composition, and are readily ascertainable by one of ordinary skill in the art without undue experimentation.

Molding allows rapid and efficient manufacture of the dielectric volume, optionally together with another DRA component(s) as an embedded feature or a surface feature. For example, a metal, ceramic, or other insert can be placed in the mold to provide a component of the DRA, such as a signal feed, ground component, or reflector component as embedded or surface feature. Alternatively, an embedded feature can be 3D printed or inkjet printed onto a volume, followed by further molding; or a surface feature can be 3D printed or inkjet printed onto an outermost surface of the DRA. It is also possible to mold the volume directly onto the ground structure, or into a container comprising a material having a dielectric constant between 1 and 3.

The mold can have a mold insert comprising a molded or machined ceramic to provide the package or volume. Use of a ceramic insert can lead to lower loss resulting in higher efficiency; reduced cost due to low direct material cost for molded alumina; ease of manufactured and controlled (constrained) thermal expansion of the polymer. It can also provide a balanced coefficient of thermal expansion (CTE) such that the overall structure matches the CTE of copper or aluminum.

The injectable composition can be prepared by first combining the ceramic filler and the silane to form a filler composition and then mixing the filler composition with the thermoplastic polymer or thermosetting composition. For a thermoplastic polymer, the polymer can be melted prior to, after, or during the mixing with one or both of the ceramic filler and the silane. The injectable composition can then be injection molded in a mold. The melt temperature, the injection temperature, and the mold temperature used depend on the melt and glass transition temperature of the thermoplastic polymer, and can be, for example, 150 to 350° C., or 200 to 300° C. The molding can occur at a pressure of 65 to 350 kiloPascal (kPa).

In some embodiments, the dielectric volume can be prepared by reaction injection molding a thermosetting composition. The reaction injection molding can comprise mixing at least two streams to form a thermosetting composition, and injecting the thermosetting composition into the mold, wherein a first stream comprises the catalyst and the second stream optionally comprises an activating agent. One or both of the first stream and the second stream or a third stream can comprise a monomer or a curable composition. One or both of the first stream and the second stream or a third stream can comprise one or both of a dielectric filler and an additive. One or both of the dielectric filler and the additive can be added to the mold prior to injecting the thermosetting composition.

For example, a method of preparing the volume can comprise mixing a first stream comprising the catalyst and a first monomer or curable composition and a second stream comprising the optional activating agent and a second monomer or curable composition. The first and second monomer or curable composition can be the same or different. One or both of the first stream and the second stream can comprise the dielectric filler. The dielectric filler can be added as a third stream, for example, further comprising a third monomer. The dielectric filler can be in the mold prior to injection of the first and second streams. The introducing of one or more of the streams can occur under an inert gas, for example, nitrogen or argon.

The mixing can occur in a head space of an injection molding machine, or in an inline mixer, or during injecting into the mold. The mixing can occur at a temperature of greater than or equal to 0 to 200 degrees Celsius (° C.), specifically, 15 to 130° C., or 0 to 45° C., more specifically, 23 to 45° C.

The mold can be maintained at a temperature of greater than or equal to 0 to 250° C., specifically, 23 to 200° C. or 45 to 250° C., more specifically, 30 to 130° C. or 50 to 70° C. It can take 0.25 to 0.5 minutes to fill a mold, during which time, the mold temperature can drop. After the mold is filled, the temperature of the thermosetting composition can increase, for example, from a first temperature of 0° to 45° C. to a second temperature of 45 to 250° C. The molding can occur at a pressure of 65 to 350 kiloPascal (kPa). The molding can occur for less than or equal to 5 minutes, specifically, less than or equal to 2 minutes, more specifically, 2 to 30 seconds. After the polymerization is complete, the substrate can be removed at the mold temperature or at a decreased mold temperature. For example, the release temperature, $T_r$, can be less than or equal to 10° C. less than the molding temperature, $T_m$($T_r \leq T_m - 10°$ C.).

After the volume is removed from the mold, it can be post-cured. Post-curing can occur at a temperature of 100 to 150° C., specifically, 140 to 200° C. for greater than or equal to 5 minutes.

Compression molding can be used with either thermoplastic or thermosetting materials. Conditions for compression molding a thermoplastic material, such as mold temperature, depend on the melt and glass transition temperature of the thermoplastic polymer, and can be, for example, 150 to 350° C., or 200 to 300° C. The molding can occur at a pressure of 65 to 350 kiloPascal (kPa). The molding can occur for less than or equal to 5 minutes, specifically, less than or equal to 2 minutes, more specifically, 2 to 30 seconds. A thermosetting material can be compression molded before B-staging to produce a B-stated material or a fully cured material; or it can be compression molded after it has been B-staged, and fully cured in the mold or after molding.

3D printing allows rapid and efficient manufacture of the dielectric volume, optionally together with another DRA component(s) as an embedded feature or a surface feature.

For example, a metal, ceramic, or other insert can be placed during printing provide a component of the DRA, such as a signal feed, ground component, or reflector component as embedded or surface feature. Alternatively, an embedded feature can be 3D printed or inkjet printed onto a volume, followed by further printing; or a surface feature can be 3D printed or inkjet printed onto an outermost surface of the DRA. It is also possible to 3D print the volume directly onto the ground structure, or into the container comprising a material having a dielectric constant between 1 and 3, where the container may be useful for embedding a unit cells of an array.

A wide variety of 3D printing methods can be used, for example fused deposition modeling (FDM), selective laser sintering (SLS), selective laser melting (SLM), electronic beam melting (EBM), Big Area Additive Manufacturing (BAAM), ARBURG plastic free forming technology, laminated object manufacturing (LOM), pumped deposition (also known as controlled paste extrusion, as described, for example, at: http://nscrypt.com/micro-dispensing), or other 3D printing methods. 3D printing can be used in the manufacture of prototypes or as a production process. In some embodiments the volume or the DRA is manufactured only by 3D or inkjet printing, such that the method of forming the dielectric volume or the DRA is free of an extrusion, molding, or lamination process.

Material extrusion techniques are particularly useful with thermoplastics, and can be used to provide intricate features. Material extrusion techniques include techniques such as FDM, pumped deposition, and fused filament fabrication, as well as others as described in ASTM F2792-12a. In fused material extrusion techniques, an article can be produced by heating a thermoplastic material to a flowable state that can be deposited to form a layer. The layer can have a predetermined shape in the x-y axis and a predetermined thickness in the z-axis. The flowable material can be deposited as roads as described above, or through a die to provide a specific profile. The layer cools and solidifies as it is deposited. A subsequent layer of melted thermoplastic material fuses to the previously deposited layer, and solidifies upon a drop in temperature. Extrusion of multiple subsequent layers builds the desired shape of the volume. In particular, an article can be formed from a three-dimensional digital representation of the article by depositing the flowable material as one or more roads on a substrate in an x-y plane to form the layer. The position of the dispenser (e.g., a nozzle) relative to the substrate is then incremented along a z-axis (perpendicular to the x-y plane), and the process is then repeated to form an article from the digital representation. The dispensed material is thus also referred to as a "modeling material" as well as a "build material."

In some embodiments the volume may be extruded from two or more nozzles, each extruding the same dielectric composition. If multiple nozzles are used, the method can produce the product objects faster than methods that use a single nozzle, and can allow increased flexibility in terms of using different polymers or blends of polymers, different colors, or textures, and the like. Accordingly, in an embodiment, a composition or property of a single volume can be varied during deposition using two nozzles.

Material extrusion techniques can further be used of the deposition of thermosetting compositions. For example, at least two streams can be mixed and deposited to form the volume. A first stream can include catalyst and a second stream can optionally comprise an activating agent. One or both of the first stream and the second stream or a third stream can comprise the monomer or curable composition (e.g., resin). One or both of the first stream and the second stream or a third stream can comprise one or both of a dielectric filler and an additive. One or both of the dielectric filler and the additive can be added to the mold prior to injecting the thermosetting composition.

For example, a method of preparing the volume can comprise mixing a first stream comprising the catalyst and a first monomer or curable composition and a second stream comprising the optional activating agent and a second monomer or curable composition. The first and second monomer or curable composition can be the same or different. One or both of the first stream and the second stream can comprise the dielectric filler. The dielectric filler can be added as a third stream, for example, further comprising a third monomer. The depositing of one or more of the streams can occur under an inert gas, for example, nitrogen or argon. The mixing can occur prior to deposition, in an inline mixer, or during deposition of the layer. Full or partial curing (polymerization or crosslinking) can be initiated prior to deposition, during deposition of the layer, or after deposition. In an embodiment, partial curing is initiated prior to or during deposition of the layer, and full curing is initiated after deposition of the layer or after deposition of the plurality of layers that provides the volume.

In some embodiments a support material as is known in the art can optionally be used to form a support structure. In these embodiments, the build material and the support material can be selectively dispensed during manufacture of the article to provide the article and a support structure. The support material can be present in the form of a support structure, for example a scaffolding that can be mechanically removed or washed away when the layering process is completed to the desired degree.

Stereolithographic techniques can also be used, such as selective laser sintering (SLS), selective laser melting (SLM), electronic beam melting (EBM), and powder bed jetting of binder or solvents to form successive layers in a preset pattern. Stereolithographic techniques are especially useful with thermosetting compositions, as the layer-by-layer buildup can occur by polymerizing or crosslinking each layer.

As described above, the dielectric composition can comprise a thermoplastic polymer or a thermosetting composition. The thermoplastic can be melted, or dissolved in a suitable solvent. The thermosetting composition can be a liquid thermosetting composition, or dissolved in a solvent. The solvent can be removed after applying the dielectric composition by heat, air drying, or other technique. The thermosetting composition can be B-staged, or fully polymerized or cured after applying to form the second volume. Polymerization or cure can be initiated during applying the dielectric composition.

Embodiments disclosed herein may be suitable for a variety of antenna applications, such as microwave antenna applications operating within a frequency range of 1 GHz to 30 GHz, or such as millimeter-wave antenna applications operating within a frequency range of 30 GHz to 100 GHz, for example. In an embodiment, the microwave antenna applications may include an array of DRAs that are separate elements on separate substrates that are individually fed by corresponding electromagnetic signal feeds, and the millimeter-wave antenna applications may include an array of DRAs that are disposed on a common substrate. Additionally, non-planar antennas are of particular interest for conformal antenna applications.

In view of all of the foregoing, it will be appreciated that at least the following arrangements are disclosed herein:

Arrangement-1: An electromagnetic device, comprising: an electrically conductive ground structure; at least one dielectric resonator antenna (DRA) disposed on the ground structure; at least one electromagnetic (EM) beam shaper disposed proximate a corresponding one of the DRA; and at least one signal feed disposed electromagnetically coupled to a corresponding one of the DRA; wherein the at least one EM beam shaper comprises: an electrically conductive horn; a body of dielectric material having a dielectric constant that varies from an internal portion of the body to an outer surface of the body; or, both the electrically conductive horn and the body of dielectric material.

Arrangement-2. The device of Arrangement-1, wherein: the at least one DRA comprises a multi-layered DRA comprising two or more non-gaseous dielectric materials with different dielectric constants.

Arrangement-3. The device of Arrangement-1, wherein: the at least one DRA comprises a single-layered DRA having a hollow core.

Arrangement-4. The device of Arrangement-1, wherein: the at least one DRA comprises a multi-layered DRA having a hollow core.

Arrangement-5. The device of Arrangement-1, wherein: the at least one DRA comprises a DRA having a convex top.

Arrangement-6. The device of Arrangement-1, wherein: the at least one DRA comprises a DRA comprising a plan view cross section having a geometric form other than a rectangle.

Arrangement-7. The device of Arrangement-1, wherein: the at least one DRA comprises a DRA comprising a plan view cross section having a geometric form of a circle, an oval, an ovaloid, an ellipse, or an ellipsoid.

Arrangement-8. The device of Arrangement-1, wherein: the at least one DRA comprises a DRA comprising an elevation view cross section having a geometric form other than a rectangle.

Arrangement-9. The device of Arrangement-1, wherein: the at least one DRA comprises a DRA comprising an elevation view cross section having vertical side walls and a convex top.

Arrangement-10. The device of Arrangement-1, wherein: the at least one DRA comprises a DRA having an overall height and an overall width where the overall height is greater than the overall width.

Arrangement-11. The device of any of Arrangements 1 to 10, wherein: the body of dielectric material is a sphere of dielectric material, and the sphere of dielectric material has a dielectric constant that varies from the center of the sphere to the outer surface of the sphere.

Arrangement-12. The device of any of Arrangements 1 to 11, wherein each DRA of the at least one DRA comprises: a plurality of volumes of dielectric materials comprising N volumes, N being an integer equal to or greater than 3, disposed to form successive and sequential layered volumes V(i), i being an integer from 1 to N, wherein volume V(1) forms an innermost first volume, wherein a successive volume V(i+1) forms a layered shell disposed over and at least partially embedding volume V(i), wherein volume V(N) at least partially embeds all volumes V(1) to V(N−1); and wherein each signal feed is disposed electromagnetically coupled to a corresponding one of the plurality of volumes of dielectric materials.

Arrangement-13. The device of any of Arrangements 1 to 12, wherein each DRA of the at least one DRA comprises: a volume comprising non-gaseous dielectric material, the volume having a hollow core, a cross sectional overall maximum height Hv as observed in an elevation view, and a cross sectional overall maximum width Wv as observed in a plan view; wherein the volume is a volume of a single dielectric material composition; and wherein Hv is greater than Wv.

Arrangement-14. The device of any of Arrangements 1 to 13, wherein: the EM beam shaper comprises the electrically conductive horn; and the electrically conductive horn comprises side walls that diverge outwards from a first proximal end to a second distal end, the first proximal end disposed in electrical contact with the ground structure, the second distal end disposed at a distance from the associated at least one DRA, the side walls disposed surrounding the corresponding at least one DRA.

Arrangement-15. The device of any of Arrangements 1 to 13, wherein: the EM beam shaper comprises the body of dielectric material; and the at least one DRA is at least partially embedded in the body of dielectric material.

Arrangement-16. The device of Arrangement-11, wherein: the sphere of dielectric material has a dielectric constant that decreases from the center of the sphere to the outer surface of the sphere.

Arrangement-17. The device of Arrangement-11, wherein: the sphere of dielectric material comprises a plurality of layers of dielectric materials having different dielectric constants that decrease from the center of the sphere to the outer surface of the sphere.

Arrangement-18. The device of any of Arrangements 1 to 17, wherein: the body of dielectric material has a dielectric constant of 1 at the outer surface of the body.

Arrangement-19. The device of any of Arrangements 1 to 13, wherein: the EM beam shaper comprises the electrically conductive horn; the at least one DRA comprises an array of the at least one DRA to form an array of DRAs; and the array of DRAs are disposed within the electrically conductive horn.

Arrangement-20. The device of any of Arrangements 1 to 13, wherein: the EM beam shaper comprises the body of dielectric material; and the at least one DRA comprises an array of the at least one DRA to form an array of DRAs; and the array of DRAs are disposed at least partially around the outer surface of the body of dielectric material.

Arrangement-21. The device of Arrangement-14, wherein: the EM beam shaper further comprises the body of dielectric material, the distal end of the electrically conductive horn having an aperture that is equal to or greater than the overall outside dimension of the body of dielectric material.

Arrangement-22. The device of Arrangement-21, wherein: a length, Lh, of the electrically conductive horn is less than an overall outside dimension, Ds, of the body of dielectric material.

Arrangement-23. The device of Arrangement-21, wherein: the at least one DRA comprises an array of the at least one DRA to form an array of DRAs; and the array of DRAs are disposed at least partially around the outer surface of the body of dielectric material in a concave arrangement.

Arrangement-24. The device of any of Arrangements 1 to 23, wherein: each DRA of the array of DRAs is separately fed by a corresponding one of the at least one signal feed to provide a multi-beam antenna.

Arrangement-25. The device of any of Arrangements 1 to 23, wherein: each DRA of the array of DRAs is selectably fed by a separate signal feed to provide a steerable multi-beam antenna.

Arrangement-26. The device of any of Arrangements 1 to 25, wherein: the at least one DRA comprises an array of the at least one DRA to form an array of DRAs; and the array of DRAs are disposed on the ground structure, and the ground structure is disposed on a non-planar substrate.

Arrangement-27. The device of Arrangement-26, wherein: the substrate comprises a concave curvature; and the array of DRAs are disposed on a concave curvature of the non-planar substrate.

Arrangement-28. The device of Arrangement-26, wherein: the substrate comprises a convex curvature; and the array of DRAs are disposed on a convex curvature of the non-planar substrate.

Arrangement-29. The device of any of Arrangements 26 to 28, wherein: the substrate is flexible.

Arrangement-30. An electromagnetic device, comprising: an array of individual three-dimensional dielectric resonator antennas (DRAs) arranged in a non-planar arrangement.

Arrangement-31. The device of Arrangement-30, further comprising: a substrate upon which the array of DRAs are disposed.

Arrangement-32. The device of Arrangement-31, wherein: the substrate comprises a concave curvature; and the array of DRAs are disposed on the concave curvature.

Arrangement-33. The device of Arrangement-31, wherein: the substrate comprises a convex curvature; and the array of DRAs are disposed on the convex curvature.

Arrangement-34. The device of any on Arrangements 31 to 33, wherein: the substrate is flexible.

Arrangement-35. The device of any of Arrangements 30 to 34, further comprising: an electrically conductive ground structure upon which the array of DRAs are disposed; an array of electromagnetic (EM) beam shapers disposed in one-to-one correspondence proximate a corresponding one of the DRAs; and a plurality of signal feeds disposed in one-to-one correspondence with and electromagnetically coupled to a corresponding one of the DRAs.

Arrangement-36. The device of Arrangement-35, wherein: each EM beam shaper of the array of EM beam shapers comprises: an electrically conductive horn; a body of dielectric material having a dielectric constant that varies from an internal portion of the body to an outer surface of the body; or, both the electrically conductive horn and the body of dielectric material.

Arrangement-37. The device of Arrangement-36, wherein: the electrically conductive horn comprises side walls that diverge outwards from a first proximal end to a second distal end, the first proximal end disposed in electrical contact with the ground structure, the second distal end disposed at a distance from the associated at least one DRA, the side walls disposed surrounding the corresponding at least one DRA.

Arrangement-38. The device of Arrangement-36, wherein: the at least one DRA comprises at least one of: a multi-layered DRA comprising two or more non-gaseous dielectric materials with different dielectric constants; a single-layered DRA having a hollow core; a DRA having a convex top; a DRA comprising a plan view cross section having a geometric form other than a rectangle; a DRA comprising a plan view cross section having a geometric form of a circle, an oval, an ovaloid, an ellipse, or an ellipsoid; a DRA comprising an elevation view cross section having a geometric form other than a rectangle; a DRA comprising an elevation view cross section having vertical side walls and a convex top; or, a DRA having an overall height and an overall width where the overall height is greater than the overall width.

Arrangement-39. The device of any of Arrangements 36 to 38, wherein: the body of dielectric material is a sphere of dielectric material, and the sphere of dielectric material has a dielectric constant that varies from the center of the sphere to the outer surface of the sphere.

Arrangement-40. An electromagnetic device, comprising: an electrically conductive ground structure; an array of dielectric resonator antennas (DRAs) disposed on the ground structure, wherein the ground structure is arranged in a non-planar arrangement; an array of electromagnetic (EM) beam shapers disposed in one-to-one correspondence proximate a corresponding one of the DRAs; and a plurality of signal feeds disposed in one-to-one correspondence with and electromagnetically coupled to a corresponding one of the DRAs.

Arrangement-41. The device of Arrangement-40, wherein: the ground structure is disposed on a non-planar substrate.

Arrangement-42. The device of Arrangement-41, wherein: the substrate comprises a concave curvature; and the array of DRAs are disposed on the concave curvature.

Arrangement-43. The device of Arrangement-41, wherein: the substrate comprises a convex curvature; and the array of DRAs are disposed on the convex curvature.

Arrangement-44. The device of any of Arrangements 41 to 43, wherein: the substrate is flexible.

Arrangement-45. The device of any of Arrangements 40 to 44, wherein: each EM beam shaper of the array of EM beam shapers comprises: an electrically conductive horn; a body of dielectric material having a dielectric constant that varies from an internal portion of the body to an outer surface of the body; or, both the electrically conductive horn and the body of dielectric material.

Arrangement-46. The device of Arrangement-45, wherein: the electrically conductive horn comprises side walls that diverge outwards from a first proximal end to a second distal end, the first proximal end disposed in electrical contact with the ground structure, the second distal end disposed at a distance from the associated at least one DRA, the side walls disposed surrounding the corresponding at least one DRA.

Arrangement-47. The device of Arrangement-45, wherein: the at least one DRA comprises at least one of: a multi-layered DRA comprising two or more non-gaseous dielectric materials with different dielectric constants; a single-layered DRA having a hollow core; a DRA having a convex top; a DRA comprising a plan view cross section having a geometric form other than a rectangle; a DRA comprising a plan view cross section having a geometric form of a circle, an oval, an ovaloid, an ellipse, or an ellipsoid; a DRA comprising an elevation view cross section having a geometric form other than a rectangle; a DRA comprising an elevation view cross section having vertical side walls and a convex top; or, a DRA having an overall height and an overall width where the overall height is greater than the overall width.

Arrangement-48. The device of any of Arrangements 45 to 47, wherein: the body of dielectric material is a sphere of dielectric material, and the sphere of dielectric material has a dielectric constant that varies from the center of the sphere to the outer surface of the sphere.

When an element such as a layer, film, region, substrate, or other described feature is referred to as being "on" another element, it can be directly on the other element, or intervening elements may also be present. In contrast, when an element is referred to as being "directly on" another element, there are no intervening elements present. The use of the terms first, second, etc. do not denote any order or importance, but rather the terms first, second, etc. are used to distinguish one element from another. The use of the terms a, an, etc. do not denote a limitation of quantity, but rather denote the presence of at least one of the referenced item. "Or" means "and/or" unless clearly stated otherwise. The term "comprising" as used herein does not exclude the possible inclusion of one or more additional features. And, any background information provided herein is provided to reveal information believed by the applicant to be of possible relevance to the invention disclosed herein. No admission is necessarily intended, nor should be construed, that any of such background information constitutes prior art against an embodiment of the invention disclosed herein.

While an invention has been described herein with reference to example embodiments, it will be understood by those skilled in the art that various changes may be made and equivalents may be substituted for elements thereof without departing from the scope of the claims. Many modifications may be made to adapt a particular situation or material to the teachings of the invention without departing from the essential scope thereof. Therefore, it is intended that the invention not be limited to the particular embodiment or embodiments disclosed herein as the best or only mode contemplated for carrying out this invention, but that the invention will include all embodiments falling within the scope of the appended claims. In the drawings and the description, there have been disclosed example embodiments and, although specific terms or dimensions may have been employed, they are unless otherwise stated used in a generic, exemplary or descriptive sense only and not for purposes of limitation, the scope of the claims therefore not being so limited.

The invention claimed is:

1. An electromagnetic device, comprising:

an electrically conductive ground structure;

at least one dielectric resonator antenna (DRA) disposed on the ground structure, the at least one DRA comprising a DRA having an overall height and an overall width where the overall height is greater than the overall width;

at least one electromagnetic (EM) beam shaper disposed proximate a corresponding one of the DRA; and at least one signal feed disposed electromagnetically coupled to a corresponding one of the DRA;

wherein the at least one EM beam shaper comprises a body of dielectric material having a dielectric constant that varies from an internal portion of the body to an outer surface of the body;

wherein the at least one DRA comprises an array of the at least one DRA to form an array of DRAs; and wherein the array of DRAs are disposed at least partially around the outer surface of the body of dielectric material.

2. The device of claim 1, wherein:

the at least one DRA comprises a single-layered DRA having a hollow core.

3. The device of claim 1, wherein:

the at least one DRA comprises a multi-layered DRA having a hollow core.

4. The device of claim 1, wherein:

the at least one DRA comprises a DRA comprising an elevation view cross section having vertical side walls and a convex top.

5. The device of claim 1, wherein:

the body of dielectric material is a sphere of dielectric material, and the sphere of dielectric material has a dielectric constant that varies from the center of the sphere to the outer surface of the sphere.

6. The device of any of claim 1, wherein each DRA of the at least one DRA comprises:

a volume comprising non-gaseous dielectric material, the volume having a hollow core, a cross sectional overall maximum height Hv as observed in an elevation view, and a cross sectional overall maximum width Wv as observed in a plan view;

wherein the volume is a volume of a single dielectric material composition; and wherein Hv is greater than Wv.

7. The device of claim 1, wherein:

the EM beam shaper further comprises an electrically conductive horn; and the electrically conductive horn comprises side walls that diverge outwards from a first proximal end to a second distal end, the first proximal end disposed in electrical contact with the ground structure, the second distal end disposed at a distance from the associated at least one DRA, the side walls disposed surrounding the corresponding at least one DRA.

8. The device of claim 1, wherein:

the at least one DRA is at least partially embedded in the body of dielectric material.

9. The device of claim 5, wherein:

the sphere of dielectric material comprises a plurality of layers of dielectric materials having different dielectric constants that decrease from the center of the sphere to the outer surface of the sphere.

10. The device of claim 1, wherein:

the EM beam shaper further comprises an electrically conductive horn;

the at least one DRA comprises an array of the at least one DRA to form an array of DRAs; and the array of DRAs are disposed within the electrically conductive horn.

11. The device of claim 7, wherein:

the distal end of the electrically conductive horn having an aperture that is equal to or greater than the overall outside dimension of the body of dielectric material.

12. The device of claim 11, wherein:

a length, Lh, of the electrically conductive horn is less than an overall outside dimension, Ds, of the body of dielectric material.

13. The device of claim 1, wherein:

the array of DRAs are disposed at least partially around the outer surface of the body of dielectric material in a concave arrangement.

14. The device of claim 1, wherein:

each DRA of the array of DRAs is separately fed by a corresponding one of the at least one signal feed to provide a multi-beam antenna.

15. An electromagnetic device, comprising:

an electrically conductive ground structure;

at least one dielectric resonator antenna (DRA) disposed on the ground structure, the at least one DRA comprising a DRA having an overall height and an overall width where the overall height is greater than the overall width;

at least one electromagnetic (EM) beam shaper disposed proximate a corresponding one of the DRA; and at least one signal feed disposed electromagnetically coupled to a corresponding one of the DRA;

wherein the at least one EM beam shaper comprises a body of dielectric material having a dielectric constant that varies from an internal portion of the body to an outer surface of the body;

wherein the at least one DRA comprises an array of the at least one DRA to form an array of DRAs; and wherein the array of DRAs are disposed on the ground structure, and the ground structure is disposed on a non-planar substrate.

16. The device of claim 15, wherein:

the substrate comprises a concave curvature; and the array of DRAs are disposed on a concave curvature of the non-planar substrate.

17. The device of claim 15, wherein:

the substrate comprises a convex curvature; and the array of DRAs are disposed on a convex curvature of the non-planar substrate.

18. The device of claim 15, wherein:

the substrate is flexible.

* * * * *